US012575657B2

(12) United States Patent
Nie et al.

(10) Patent No.: US 12,575,657 B2
(45) Date of Patent: Mar. 17, 2026

(54) ELECTRIC HAIR DRYER SHELL ASSEMBLY WITH CONVENIENT INSTALLATION FEATURES AND ELECTRIC HAIR DRYER

(71) Applicant: DREAME TECHNOLOGY (SHANGHAI) CO., LTD., Shanghai (CN)

(72) Inventors: Wenming Nie, Shanghai (CN); Peng Wang, Shanghai (CN)

(73) Assignee: DREAME TECHNOLOGY (SHANGHAI) CO., LTD., Shanghai (CN)

( * ) Notice: Subject to any disclaimer, the term of this patent is extended or adjusted under 35 U.S.C. 154(b) by 767 days.

(21) Appl. No.: 17/910,815

(22) PCT Filed: Apr. 30, 2021

(86) PCT No.: PCT/CN2021/091790
§ 371 (c)(1),
(2) Date: Sep. 11, 2022

(87) PCT Pub. No.: WO2021/223689
PCT Pub. Date: Nov. 11, 2021

(65) Prior Publication Data

US 2023/0122821 A1 Apr. 20, 2023

(30) Foreign Application Priority Data

May 6, 2020 (CN) ..... 202010370804.6
May 6, 2020 (CN) ..... 202020717336.0
(Continued)

(51) Int. Cl.
*A45D 20/00* (2006.01)

(52) U.S. Cl.
CPC ..... *A45D 20/00* (2013.01)

(58) Field of Classification Search
CPC ..... A45D 20/00
(Continued)

(56) References Cited

U.S. PATENT DOCUMENTS 3,905,379 A * 9/1975 Churas ..... A45D 20/10 392/380
5,642,570 A * 7/1997 Lee ..... B05B 7/2416 34/98
(Continued)

FOREIGN PATENT DOCUMENTS

CN 101202171 A 6/2008
CN 102148106 A 8/2011
(Continued)

*Primary Examiner* — Stephen M Gravini
(74) *Attorney, Agent, or Firm* — Bayramoglu Law Offices LLC

(57) ABSTRACT

A push button assembly, applied to a hair dryer which having a handle with an adjustment switch inside, includes: a push button arranged on an outside of the handle, the push button having a first snap structure extending into an inside of the handle; and a sliding member arranged inside the handle and having a second snap structure, the sliding member being configured to connect the push button and the adjustment switch. The push button is snapped to the sliding member through a cooperation between the first snap structure and the second snap structure, so as to push a trigger portion on the adjustment switch to slide linearly in an axial direction of the handle. A hair dryer having the push button assembly is also disclosed.

20 Claims, 26 Drawing Sheets

(30) Foreign Application Priority Data

May 15, 2020 (CN) ..... 202010411310.8
May 15, 2020 (CN) ..... 202010411784.2
May 15, 2020 (CN) ..... 202010411791.2
May 15, 2020 (CN) ..... 202020808497.0
May 15, 2020 (CN) ..... 202020809577.8
May 15, 2020 (CN) ..... 202020809605.6

(58) Field of Classification Search
USPC ..... 34/95–100
See application file for complete search history.

(56) References Cited

U.S. PATENT DOCUMENTS

| | | | | |
|---|---|---|---|---|
| 6,973,931 | B1 * | 12/2005 | King | A45D 24/34 132/212 |
| 9,974,119 | B1 * | 5/2018 | Qasem | A61L 9/032 |
| 10,555,590 | B2 * | 2/2020 | Ohgi | A45D 20/122 |
| 10,617,828 | B2 * | 4/2020 | Weng | A61M 5/24 |
| 11,425,979 | B2 * | 8/2022 | Conrad | F24H 3/0423 |
| 11,832,700 | B2 * | 12/2023 | Udy | A45D 20/10 |
| 11,844,408 | B2 * | 12/2023 | Kim | A45D 20/26 |
| 12,004,624 | B2 * | 6/2024 | Kim | A45D 20/122 |
| 12,225,995 | B2 * | 2/2025 | Higgins | A45D 20/10 |
| 2008/0230246 | A1 * | 9/2008 | Dollar-Wright | A45D 24/007 173/29 |
| 2023/0122821 | A1 * | 4/2023 | Nie | A45D 20/00 34/96 |

FOREIGN PATENT DOCUMENTS

| | | | | | |
|---|---|---|---|---|---|
| CN | 202890940 | U | | 4/2013 | |
| CN | 103367012 | A | | 10/2013 | |
| CN | 203234205 | U | | 10/2013 | |
| CN | 104157496 | A | | 11/2014 | |
| CN | 104320991 | A | | 1/2015 | |
| CN | 204132665 | U | | 2/2015 | |
| CN | 105476245 | A | | 4/2016 | |
| CN | 105877103 | A | | 8/2016 | |
| CN | 106165959 | A | | 11/2016 | |
| CN | 206119515 | U | | 4/2017 | |
| CN | 206836513 | U | | 1/2018 | |
| CN | 108013575 | A | | 5/2018 | |
| CN | 207669245 | U | | 7/2018 | |
| CN | 108968288 | A | | 12/2018 | |
| CN | 109123983 | A | | 1/2019 | |
| CN | 208875480 | U | | 5/2019 | |
| CN | 209171525 | U | | 7/2019 | |
| CN | 209235140 | U | | 8/2019 | |
| CN | 110448029 | A | | 11/2019 | |
| CN | 209610223 | U | | 11/2019 | |
| CN | 209750152 | U | | 12/2019 | |
| CN | 210094943 | U | | 2/2020 | |
| CN | 110934405 | A | | 3/2020 | |
| CN | 110973801 | A | | 4/2020 | |
| CN | 111387674 | A | | 7/2020 | |
| CN | 111418985 | A | | 7/2020 | |
| CN | 111418987 | A | | 7/2020 | |
| CN | 111418988 | A | | 7/2020 | |
| CN | 212165176 | U | | 12/2020 | |
| CN | 212465225 | U | | 2/2021 | |
| CN | 212465231 | U | | 2/2021 | |
| CN | 212465232 | U | | 2/2021 | |
| EP | 0413959 | A2 | * | 2/1991 | A45D 20/12 |
| EP | 4115765 | A1 | * | 1/2023 | A45D 20/12 |
| JP | H7-134928 | A | | 5/1995 | |
| JP | H11-127946 | A | | 5/1999 | |
| JP | 2007-296863 | A | | 11/2007 | |
| JP | 2012-240454 | A | | 12/2012 | |
| JP | 2023512342 | A | * | 3/2023 | A45D 20/00 |
| KR | 20220141873 | A | * | 10/2022 | A45D 20/12 |
| TW | 201135773 | A | | 10/2011 | |
| WO | WO-9637125 | A1 | * | 11/1996 | A45D 20/12 |
| WO | 2019/136895 | A1 | | 7/2019 | |
| WO | WO-2021223689 | A1 | * | 11/2021 | A45D 20/12 |

* cited by examiner

ELECTRIC HAIR DRYER SHELL ASSEMBLY WITH CONVENIENT INSTALLATION FEATURES AND ELECTRIC HAIR DRYER

CROSS REFERENCE TO RELATED APPLICATIONS

The present invention is a 35 U.S.C. § 371 National Phase conversion of International (PCT) Patent Application No. PCT/CN2021/091790, filed on Apr. 30, 2021, which claims benefit of Chinese Application No. 20202071336.0, filed on May 6, 2020, Chinese Application No. 202010370804.6, filed on May 6, 2020, Chinese Application No. 202020809577.8, filed on May 15, 2020, Chinese Application No. 202010411784.2, filed on May 15, 2020, Chinese Application No. 202010411310.8, filed on May 15, 2020, Chinese Application No. 202020808497.0, filed on May 15, 2020, Chinese Application No. 202010411791.2, filed on May 15, 2020, Chinese Application No. 202020809605.6, filed on May 15, 2020, the disclosure of which is incorporated by reference herein. The PCT International Patent Application was filed and published in Chinese.

TECHNICAL FIELD

The present disclosure relates to a technical field of household appliances, and in particular, to a hair dryer shell assembly and a hair dryer.

BACKGROUND

Hair dryers are small personal care appliances that can quickly dry hair. They can be heated by heating wires to make the wind warmer, so that the hair can be dried faster.

The hair dryer includes an air cylinder portion, a handle portion and a push button assembly arranged on the handle portion. In the prior art, there are many accessories in the air cylinder portion, the handle portion and the push button assembly of the hair dryer, and the accessories are shielded from each other during assembly. Therefore, problems such as difficult assembly, complicated assembly, poor reliability, and poor air tightness exist between the air cylinder portion and the handle portion, and between the handle portion and the push button assembly.

SUMMARY

An object of the present disclosure is to provide a shell assembly of a hair dryer and the hair dryer, which can make the installation of the inner support and the air cylinder convenient, and also meet the needs of aesthetic appearance and integrity.

The present disclosure provides a hair dryer, the connection of the air cylinder and the handle shell has the advantages of stability and reliability. The technical solution adopted in the present disclosure is:

a hair dryer, including: an air cylinder; and a handle assembly disposed below the air cylinder, the handle assembly including a handle shell which is detachably disposed on the air cylinder; wherein a communication port is provided on an outer side wall of the air cylinder, a mounting rib plate is distributed in a circumferential direction of the communication port, and the mounting rib plate is configured to connect the handle assembly; wherein the mounting rib plate is provided with an air cylinder snap structure, a top of the handle shell is provided with a shell snap structure; and the shell snap structure is configured to mate with the air cylinder snap structure, so as to realize circumferential positioning and axial snapping between the air cylinder and the handle shell.

Preferably, the air cylinder snap structure includes an insertion slot M and a snap slot N formed on the mounting rib plate, and the shell snap structure includes an insertion block Q and a buckle P disposed on the top of the handle shell; or the air cylinder snap structure includes an insertion block Q1 and a buckle P1 formed on the mounting rib plate, and the shell snap structure includes an insertion slot M1 and a snap slot N1 disposed on the top of the handle shell; wherein the insertion block is matched with the insertion slot, and the buckle is matched with the snap slot.

Preferably, the handle assembly further includes a handle inner frame supporting an electronic control component, and the handle inner frame is detachably arranged in the handle shell; wherein a top of the handle inner frame is provided with an inner frame central fastening structure, the mounting rib plate is also provided with an air cylinder central fastening structure matched with the inner frame central fastening structure, the handle inner frame is connected to the air cylinder through a matching relationship between the inner frame central fastening structure and the air cylinder central fastening structure.

Preferably, the air cylinder central fastening structure includes a central positioning hole formed on the mounting rib plate, the inner frame central fastening structure includes a central positioning post and first hole posts arranged on the handle inner frame, the central positioning post and the first hole posts are distributed along an axial direction perpendicular to the handle shell; wherein the central positioning hole and the central positioning post are respectively located on symmetrical planes of the air cylinder and the handle assembly, the central positioning post is matched with the central positioning hole, the first hole posts are symmetrically arranged on both sides of the central positioning post, the first hole posts are configured to screw the air cylinder and the handle inner frame.

Preferably, the handle inner frame is a frame body of a semi-cylindrical configuration, an inner space of the handle shell is divided into a first semi-cylindrical area and a second semi-cylindrical area; wherein the handle inner frame is located in the second semi-cylindrical area, and the shell snap structure is located in the first semi-cylindrical area.

Preferably, the central positioning post is in a form of a square cylinder, and the central positioning hole is in a shape of a square hole.

Preferably, detachable connection is achieved between the handle shell and the handle inner frame through a circumferential positioning structure and an end surface positioning and fastening structure.

Preferably, the circumferential positioning structure includes a first positioning groove which is arranged on an inner wall of the top of the handle shell and a first positioning block which is arranged on an outer wall of the top of the handle inner frame; wherein the first positioning groove and the first positioning block constitute a top circumferential positioning sub structure.

Preferably, the circumferential positioning structure further includes a second positioning block which is arranged on the inner wall of a bottom of the handle shell and a second positioning groove which is arranged on the outer wall of a bottom of the handle inner frame; wherein the second positioning block and the second positioning groove constitute a bottom circumferential positioning substructure; the bottom circumferential positioning substructure and the top circumferential positioning substructure together constitute the circumferential positioning structure.

Preferably, the end surface positioning and fastening structure includes a second protrusion located at a bottom of an inner side of the handle shell, and a second hole post and an end surface positioning hole which are formed on a bottom end surface of the handle inner frame; wherein the second protrusion is fixed on an inner side wall of the handle shell and distributed along a radial direction of the handle shell; the second protrusion is provided with a through hole for a screw to pass through to the second hole post, and an end surface positioning post distributed along an axial direction of the handle shell and used for matching with the end surface positioning hole.

Compared with the prior art, the present disclosure has the beneficial effects that the hair dryer provided by the present disclosure has the handle shell installed at the communication port of the air cylinder through the cooperation between the shell snap structure and the air cylinder snap structure, which can realize the circumferential positioning and axial snapping between the air cylinder and the handle shell, and has the advantages of convenient installation, and stable and reliable connection.

The present disclosure also provides a push button assembly, which has the advantages of simple structure and convenient installation. The technical solution adopted in the present disclosure is:

a push button assembly, applied to a hair dryer which has a handle with an adjustment switch inside, including: a push button arranged on an outside of the handle, the push button having a first snap structure extending into an inside of the handle; and a sliding member arranged inside the handle and having a second snap structure, the sliding member being configured to connect the push button and the adjustment switch; wherein the push button is snapped to the sliding member through a cooperation between the first snap structure and the second snap structure, so as to push a trigger portion on the adjustment switch to slide linearly in an axial direction of the handle.

Preferably, the first snap structure includes a snap portion, and the second snap structure includes a snap slot portion; and wherein after the snap portion is snapped into the snap slot portion, the push button has a translational freedom to move along the axial direction of the handle.

Preferably, a pair of the snap portions are arranged on the push button, and width dimensions of the pair of snap portions in the axial direction of the handle are different.

Preferably, the snap portion includes a second extension block and a buckle, one end of the second extension block is fixed on the push button and grows along the axial direction perpendicular to the handle, the buckle is formed on another end of the second extension block; the snap slot portion includes a second through hole for the second extension block to pass through, and a pair of stoppers formed on both sides of the second through hole and used for locking with the snap portion; wherein after the second extension block is inserted into the second through hole and the buckle is engaged with the stoppers, an inner side wall of the push button abuts against an outer side wall of the handle.

Preferably, the inner side wall of the push button is provided with first ribs distributed along the axial direction of the handle to reduce a contact area between an inner wall of the push button and an outer wall of the handle; and wherein the first ribs are located on opposite sides of the snap portion.

Preferably, the stoppers include a first stopper engaged with the buckle and a second stopper inclined toward the first stopper; wherein the first stopper and the second stopper are arranged opposite to each other; after the buckle is engaged with the first stopper, the second stopper abuts against the second extension block, so that the second extension block abuts against the first stopper.

Preferably, the handle includes a handle shell with a hollow interior along the axial direction of the handle to form an accommodating cavity, and a handle inner frame detachably disposed in the accommodating cavity and supporting the adjustment switch; wherein the handle inner frame is provided with an opening matched with the sliding member.

Preferably, side wings are symmetrically arranged on two opposite side edges of the sliding member, the side wings are configured to restrict movement of the sliding member in a width direction and a thickness direction of the opening; and wherein a length direction of the opening is parallel to the axial direction of the handle.

Preferably, an outer side wall of the push button is formed with a protruding strip which is convenient for pushing the push button, the protruding strip is distributed along a circumferential direction of the handle; wherein a connecting line of any point on the protruding strip and any point on the trigger portion forms an included angle M with respect to the axial direction of the handle, and a value range of the included angle M is: 20° to 70°.

In order to solve the above-mentioned technical problems, another technical solution adopted in the present disclosure is:

a hair dryer, including the push button assembly as described above.

Compared with the prior art, the present disclosure has the beneficial effects that in the push button assembly and the hair dryer provided by the present disclosure, the push button is snapped to the sliding member through the cooperation between the first snap structure and the second snap structure, so as to realize the gear adjustment of the adjustment switch, and has the advantages of simple structure and convenient installation.

Figure 1:
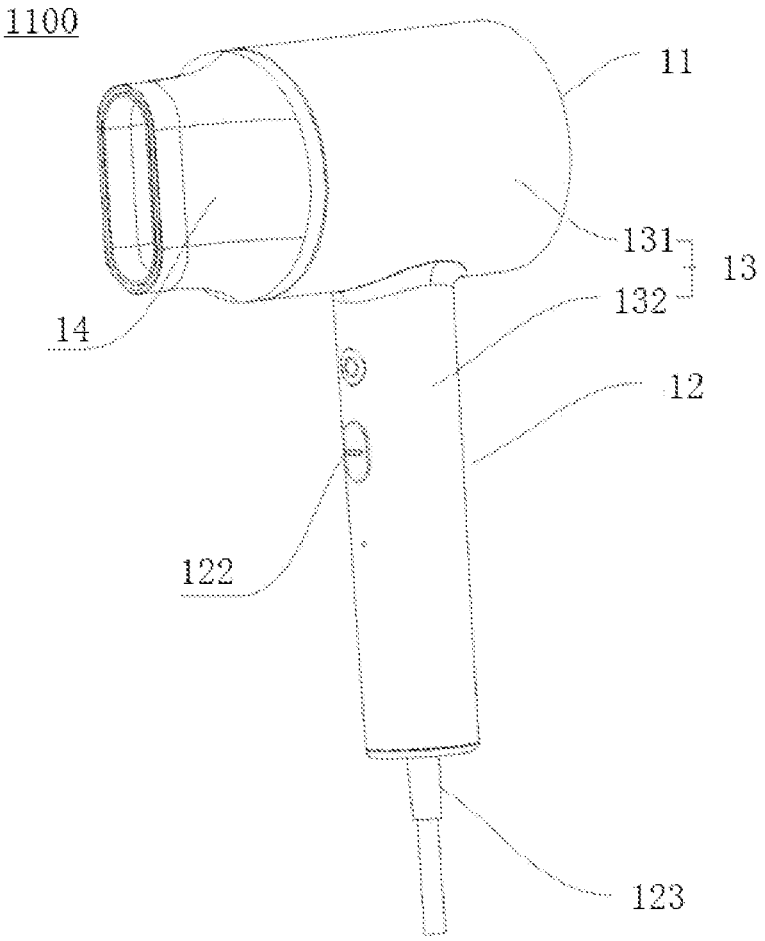
FIG. 1 is a structural schematic view of a hair dryer of the present disclosure.

Reference numerals: 1100, hair dryer; 11, air cylinder portion; 111, housing; 112, fan mechanism; 1121, motor; 1122, fan; 113, electric heating mechanism; 1131, fixing member; 1132, electric heating wire; 114, air inlet; 1141, air inlet net; 1142, filter element; 115, air outlet; 1151, air outlet net; 12, handle portion; 121, main control assembly; 122, switch assembly; 123, electric wire assembly; 13, shell assembly of hair dryer; 131, air cylinder shell; 1311, first working hole; 1312, second working hole; 1313, hole; 132, handle shell; 1321, second threaded hole; 1322, protrusion; 1323, holding element; 133, inner support; 1331, inner support body; 1332, first threaded hole; 134, cover plate; 1341, cover plate body; 1342, elastic protrusion; 14, air nozzle; 141, connecting body; 142, nozzle body; 2100, air cylinder; 2110, mounting rib plate; 2111, air cylinder snap structure; 2112, air cylinder central fastening structure; 21121, central positioning hole; 2120, communication port; 2121, convex rib; 21211, wiring groove; 2200, handle shell; 2210, shell snap structure; 2220, first positioning groove; 2230, second positioning block; 2240, second protrusion; 2241, through hole; 2250, end surface positioning post; 2300, handle inner frame; 2310, inner frame central fastening structure; 2311, central positioning post; 2312, first hole post; 2320, first positioning block; 2330, second positioning groove; 2340, second hole post; 2350, end surface positioning hole; 2400, sealing member; 2410, wiring hole;

2420, limiting flange; 2430, extension block; 2431, shoulder; 4100, handle; 4110, handle shell; 4120, handle inner frame; 4121, opening; 4130, second connection structure; 4131, second axial positioning structure; 41311, mounting hole; 41312, hole shoulder; 41313, hook; 4132, second circumferential positioning structure; 4140, push button hole; 4150, sliding slot; 4200, adjustment switch; 4210, trigger portion; 4300, push button; 4310, snap portion; 4311, second extension block; 4312, buckle; 4320, rib; 4330, protruding strip; 4400, sliding member; 4410, snap slot portion; 4411, second through hole; 4412, first stopper; 4413, second stopper; 4420, side wing; 4421, second rib; 4430, convex frame; 4500, push button; 4510, locking structure; 4511, connecting leg; 4512, push button buckle; 4520, pressing block; 4521, cover groove; 4522, button cover; 4530, rib rod; 4600, support member; 4610, first connection structure; 4611, first axial locking structure; 46111, first locking shoulder; 46112, second locking shoulder; 46113, guide groove; 4612, first axial positioning structure; 4620, partition plate; 4621, locking slot; 4622, through hole; 4700, elastic element; 4800, push switch.

DETAILED DESCRIPTION

The technical solutions of the present disclosure will be clearly and completely described below with reference to the accompanying drawings. Obviously, the described embodiments are some, but not all, embodiments of the present disclosure. Based on the embodiments in the present disclosure, all other embodiments obtained by those of ordinary skill in the art without creative efforts shall fall within the protection scope of the present disclosure.

In the description of the present disclosure, it should be noted that the orientations or positional relationships indicated by terms "center", "top", "bottom", "left", "right", "vertical", "horizontal", "inner", "outer", etc., are based on the orientations or positional relationships shown in the accompanying drawings, which is only for the convenience of describing the present disclosure and simplifying the description, rather than indicating or implying that the indicated device or element referred to must have a particular orientation, be constructed and operate in a particular orientation, and therefore should not be construed as a limitation of the present disclosure. Furthermore, the terms "first", "second", and "third" are used for descriptive purposes only and should not be construed to indicate or imply relative importance.

In the description of the present disclosure, it should also be noted that, unless there are more explicit definitions and limitations, the terms "installed", "connected" and "connection" should be understood in a broader sense. For example, the term "connection" may be a fixed connection, a detachable connection, or an integral connection; a mechanical connection or an electrical connection; a direct connection, or an indirect connection through an intermediate medium, or a communication of two elements. For those of ordinary skill in the art, the specific meanings of the above terms in the present disclosure can be understood in specific situations.

In addition, the technical features involved in the different embodiments of the present disclosure described below can be combined with each other as long as they do not conflict with each other. In the description of the present disclosure, an axis direction is consistent with a height direction.

Referring to FIG. 1, a hair dryer 1100 in a preferred embodiment of the present disclosure can be used for hair drying scenarios; or in laboratories, physiotherapy rooms, industrial production, art and other aspects for partial drying, heating and physiotherapy scenarios. This disclosure does not limit the disclosure scenarios of the hair dryer 1100. The hair dryer 1100 includes an air cylinder portion 11, a handle portion 12 connected to the air cylinder portion 11, and a shell assembly 13 of the hair dryer.

Figure 2:
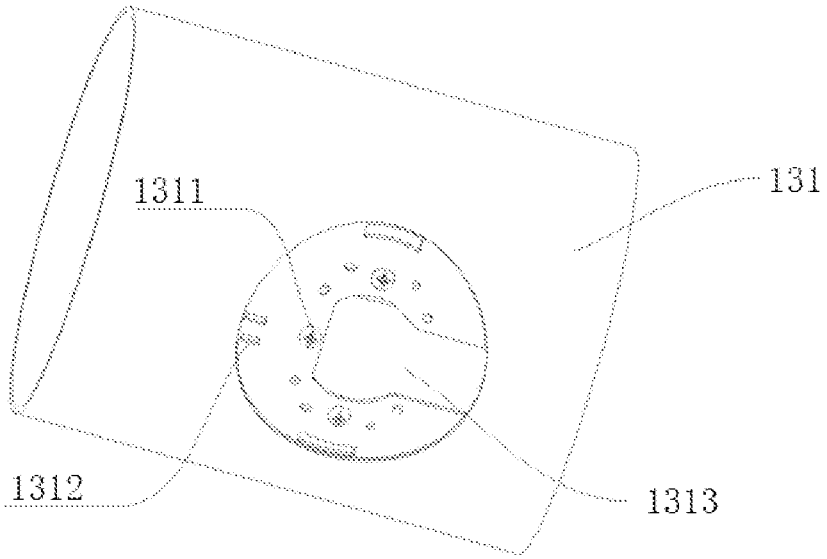
FIG. 2 is a structural schematic view of an air cylinder shell in FIG. 1.
Figure 3:
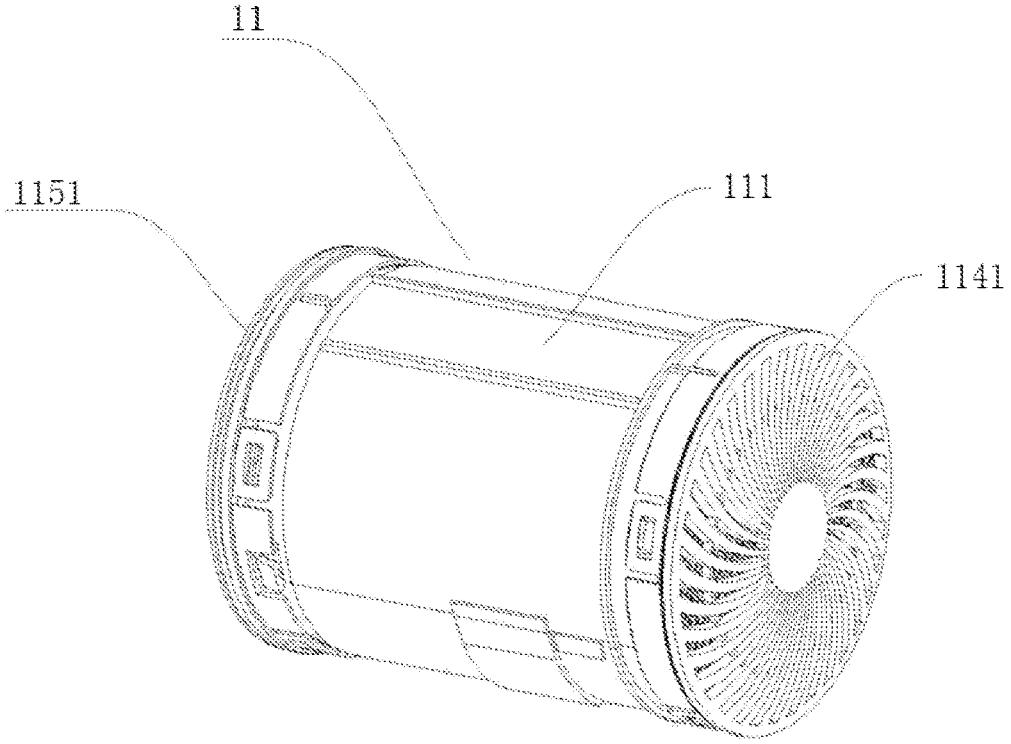
FIG. 3 is a structural schematic view of an air cylinder in FIG. 1.
Figure 5:
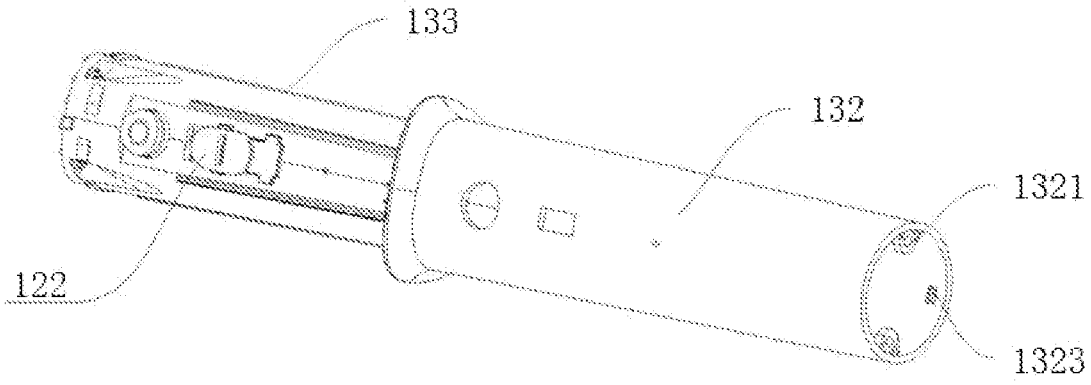
FIG. 5 is a structural schematic view of a handle shell and an inner support in FIG. 1.

Referring to FIG. 2, FIG. 3 and FIG. 5, the shell assembly 13 of the hair dryer includes an air cylinder shell 131 for accommodating the air cylinder portion 11, a handle shell 132 sleeved on the handle portion 12, and an inner support 133 accommodated in the handle shell 132. In the present embodiment, the air cylinder portion 11 is the air cylinder 11. The inner support 133 is detachably connected to the air cylinder 11. At the same time, the inner support 133 is detachably connected with the air cylinder shell 131. A first working hole 1311 is provided on the air cylinder shell 131. The inner support 133 is detachably connected to the first working hole 1311. The first working hole is opened on a side wall of the air cylinder shell 131. The purpose of this arrangement is that it is difficult to directly connect the inner support 133 with the air cylinder 11. Because the air cylinder 11 is arranged in the air cylinder shell 131, when the inner support 133 is connected to the air cylinder 11, a mating position of the air cylinder 11 and the inner support 133 cannot be clearly known due to the blocking of obstacles. After connecting the air cylinder 11 to the air cylinder shell 131 first, the air cylinder shell 131 is provided with the first working hole 1311 corresponding to the mating position. The inner support 133 is connected with the first working hole 1311 first, and then directly connected with the air cylinder 11 for connection, which is quick and convenient, and reduces the difficulty of assembly. The number of the first working holes 1311 is determined according to actual requirements, which is not specifically limited here, as long as the inner support 133 is fixedly installed with the air cylinder shell 131. In this embodiment, the first working hole 1311 is opened at a position in the middle of the side wall of the air cylinder shell 131 so as to maintain the overall aesthetics of the hair dryer 1100.

Figure 7:
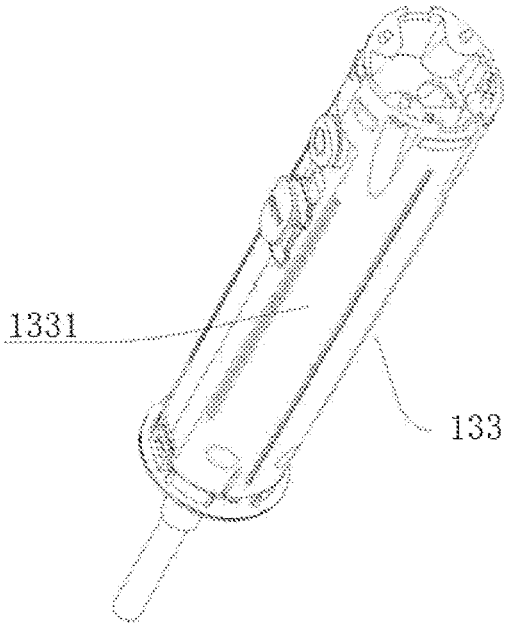
FIG. 7 is a structural schematic view of the inner support in FIG. 1.
Figure 8:
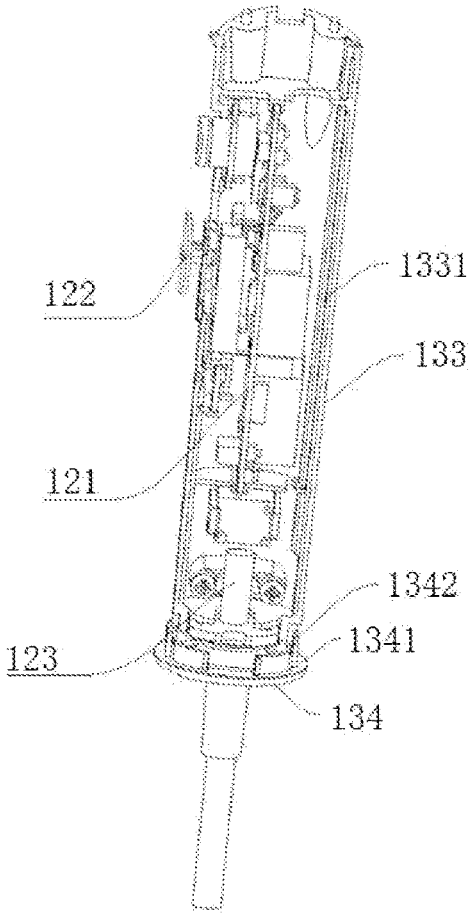
FIG. 8 is another structural schematic view of the inner support in FIG. 1.

Referring to FIG. 7 and FIG. 8, specifically, the inner support 133 includes an inner support body 1331 and a first fastener connected with the inner support body 1331. The first fastener is screwed with the first working hole 1311 so that the inner support body 1331 is detachably connected with the air cylinder shell 131. The inner support body 1331 may be integrally formed or separated, depending on the actual situation, which is not specifically limited here. In this embodiment, the inner support body 1331 is provided as a separate body. The inner support body 1331 disposed separately is fastened and connected by a third fastener.

Referring to FIG. 5, in order to improve the stability of the shell assembly 13 of the hair dryer, the handle shell 132 and the inner support 133 are detachably connected. The inner support 133 can be connected with the handle shell 132 by fasteners to achieve detachable connection. Alternatively, the inner support 133 is snapped with the handle shell 132 to realize detachable connection. The way to realize the detachable connection between the two can also be other ways, such as magnetic attraction, etc., which is not specifically limited here, and depends on the actual situation. In this embodiment, the inner support 133 and the handle shell 132 are detachably connected through a second fastener. For the aesthetics of the overall appearance of the hair dryer 1100, in a height direction of the hair dryer 1100, a rear end of the inner support 133 is provided with a first threaded hole 1332. Correspondingly, a rear end of the handle shell 132 is also provided with a second threaded hole 1321 corresponding to the position of the first threaded hole 1332. The fastener passes through the second threaded hole 1321 and the first threaded hole 1332 in sequence to connect the inner support 133 with the handle shell 132.

Figure 9:
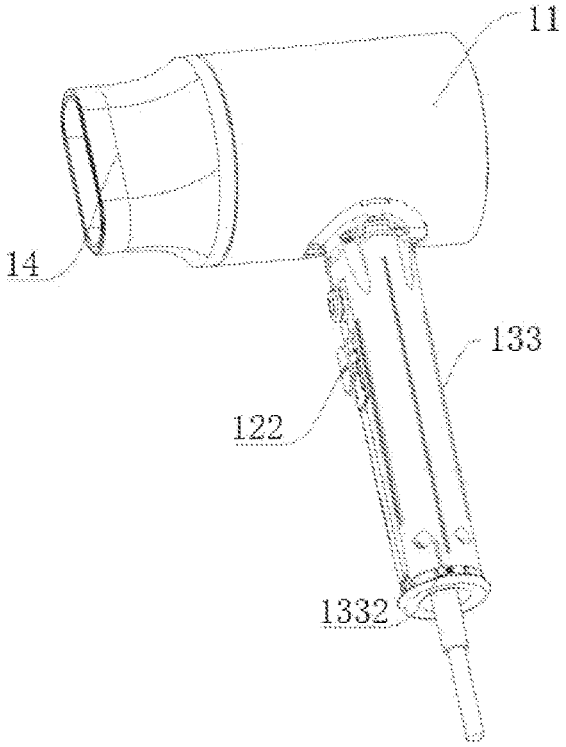
FIG. 9 is another structural schematic view of the hair dryer of the present disclosure.

Referring to FIG. 7, FIG. 8 and FIG. 9, the shell assembly 13 of the hair dryer further includes a cover plate 134 which is mounted on the handle shell 132 and the rear end of the inner support 133. After the inner support 133 is installed and fixed to the handle shell 132, the cover plate 134 is covered on the rear end of the handle shell 132 and is snapped with the handle shell 132 at the same time. The rear end of the handle shell 132 is provided with a holding element 1323. The cover plate 134 includes a cover plate body 1341 and an elastic protrusion 1342 formed on the cover plate body 1341. The elastic protrusion 1342 is engaged with the holding element 1323 so that the cover plate 134 is fixedly connected with the handle shell 132, and at the same time, the rear end of the handle shell 132 is closed.

Figure 6:
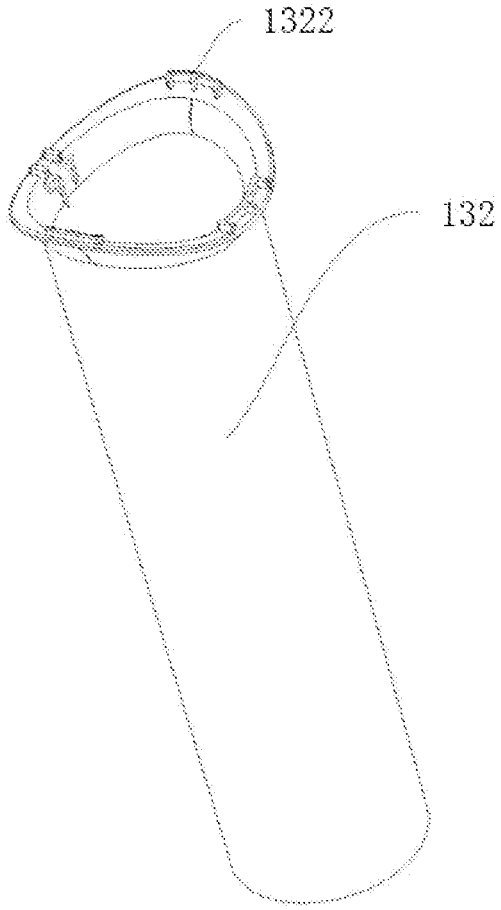
FIG. 6 is a structural schematic view of the handle shell in FIG. 1.

Referring to FIG. 2 and FIG. 6, the air cylinder shell 131 and the handle shell 132 are detachable. The shell assembly 13 of the hair dryer also includes a protrusion 1322 which connects with the handle shell 132. The air cylinder shell 131 is also provided with a second working hole 1312 which is engaged with the protrusion 1322. The second working hole 1312 is provided outside the first working hole 1311. In this embodiment, the protrusion 1322 is disposed on a front end of the handle shell 132. Of course, in other embodiments, the protrusion 1322 can also be arranged at other positions of the handle shell 132, but at the same time, the position where the inner support 133 is connected to the air cylinder shell 131 also needs to be changed accordingly. There is no specific limitation here, and it depends on the actual situation. In order to better engage the protrusion 1322 with the second working hole 1312, a plurality of radially retractable locking blocks may be disposed at the front end of the protrusion 1322 along a circumferential direction. The stopper can be snapped into the second working hole 1312 and abut against the inner wall of the second working hole 1312.

The protrusion 1322 can be integrally formed with the handle shell 132, or can be fixedly connected with the handle shell 132 by means of bonding, welding, clamping or the like. In order to simplify the manufacturing process and the overall aesthetics of the handle shell 132, in this embodiment, the protrusion 1322 is integrally formed with the handle shell 132. When the protrusion 1322 is engaged with the second working hole 1312, the end surface of the handle shell 132 abuts against the air cylinder shell 131. At the same time, the connection between the inner support 133 and the air cylinder shell 131 as well as the air cylinder 11 is just completed. When the end surface of the handle shell 132 abuts against the air cylinder shell 131, there is no small gap at a butt joint. Water and dust impurities cannot penetrate into the interior of the hair dryer 1100, and the hair dryer 1100 is not affected by the impurities and can work normally.

In order to improve the overall aesthetics and texture of the hair dryer 1100, in this embodiment, the air cylinder shell 131 and the handle shell 132 are both integrally formed, and a material of the air cylinder shell 131 and/or the handle shell 132 is metal. Of course, in other embodiments, the air cylinder shell 131 and the handle shell 132 can also be separately arranged and then clipped, welded, and bonded to form a receiving cavity. The present disclosure will not go into details here, and it will be determined according to the actual situation. However, there will be a gap in the air cylinder shell 131 and the handle shell 132 produced in this case, which affects the aesthetics. Moreover, forming the air cylinder shell 131 and the handle shell 132 in one piece can improve the sealing performance of the shell of the hair dryer 1100, effectively reduce the probability of water, dust and other impurities entering the interior of the hair dryer 1100, which is of great significance for improving the service life of the hair dryer 1100.

In the present disclosure, the air cylinder shell 131 is detachably connected to the inner support 133 and the handle shell 132 respectively, so as to reduce the difficulty of installing the hair dryer 1100 as a whole. At the same time, it can also ensure the overall centering of the hair dryer 1100, thereby improving the aesthetics and integrity of the overall appearance of the hair dryer 1100.

Figure 4:
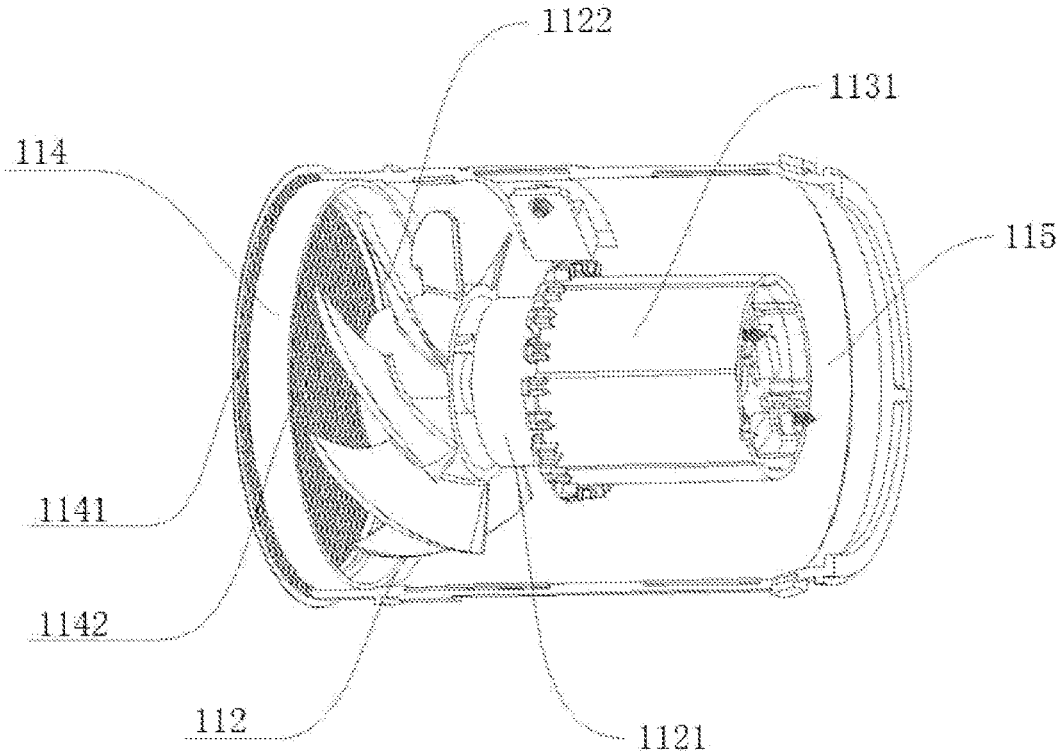
FIG. 4 is another structural schematic view of the air cylinder in FIG. 1.
Figure 10:
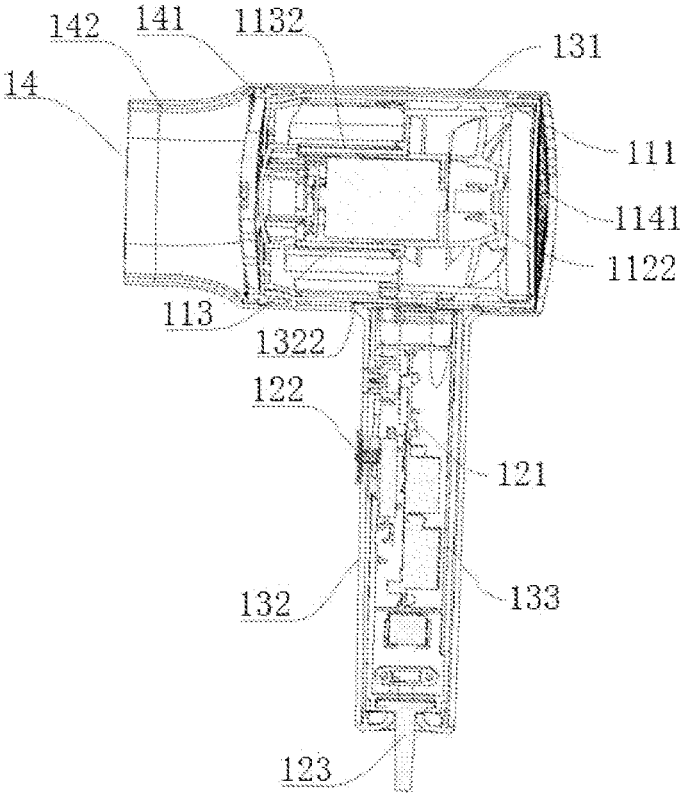
FIG. 10 is a sectional schematic view of the hair dryer of the present disclosure.
Figure 11:
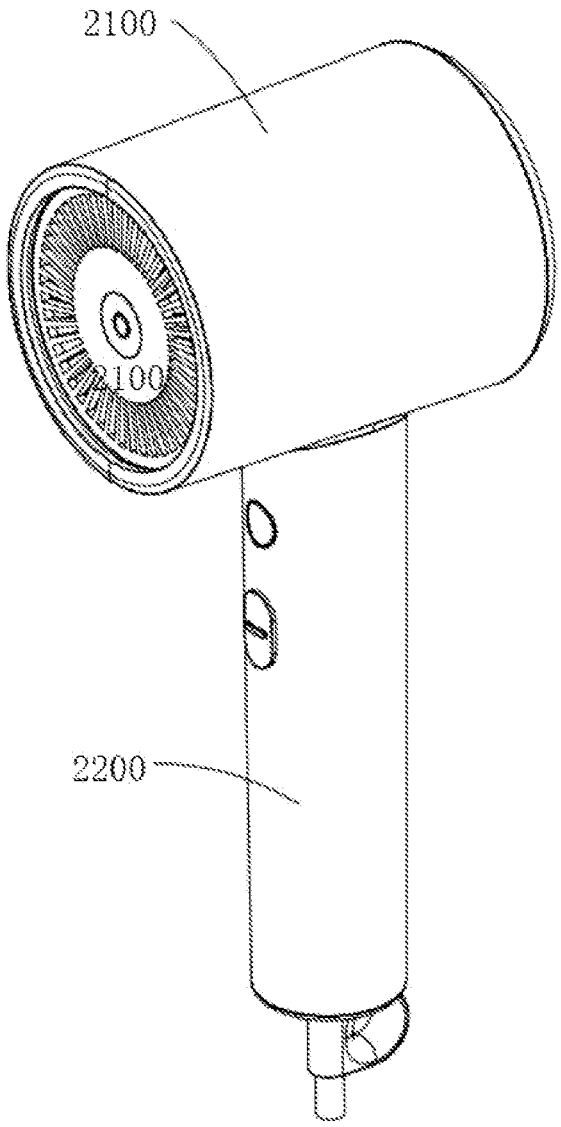
FIG. 11 is a structural schematic view of the hair dryer in another embodiment of the present disclosure.
Figure 12:
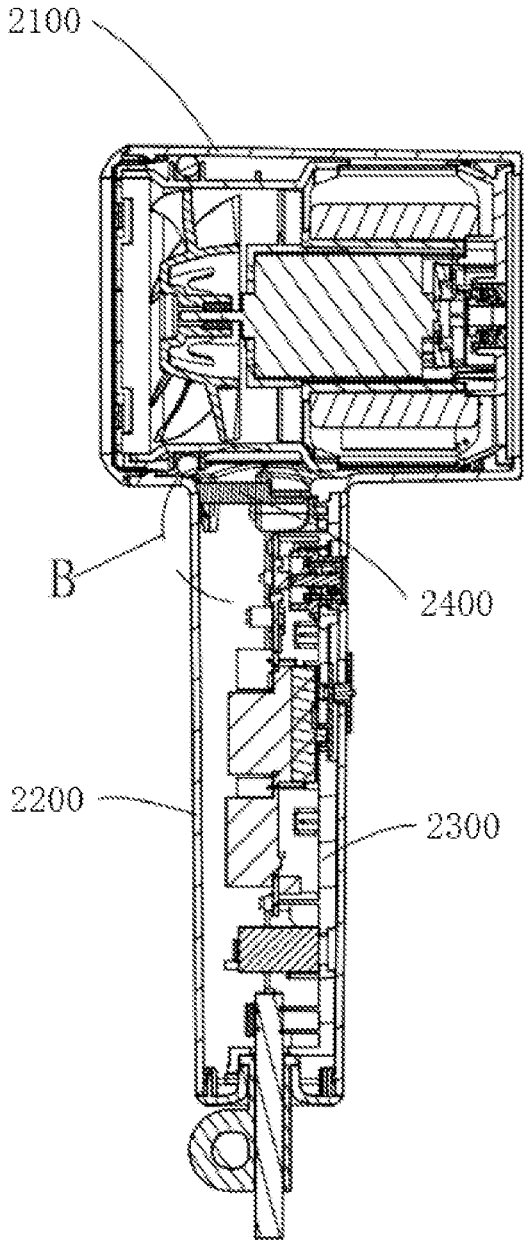
FIG. 12 is a cross-sectional schematic view of the hair dryer in another embodiment of the present disclosure.

Referring to FIG. 4 and FIG. 10, the air cylinder 11 and the air cylinder shell 131 are detachably connected to facilitate the disassembly and assembly of the air cylinder portion 11. The air cylinder 11 includes a housing 111, a fan mechanism 112 and an electric heating mechanism 113 arranged in the housing 111. The fan mechanism 112 includes a fan 1122 and a motor 1121 for driving the fan 1122 to rotate. The motor 1121 has an output shaft. The fan 1122 is connected to the output shaft. Activating the motor 1121 causes the output shaft to rotate so as to drive the fan 1122 to rotate. Taking an air outlet direction of the hair dryer 1100 as a front end, the fan 1122 rotates to form an airflow in the housing 111 and deliver the airflow to the front end of the housing 111. A heating mechanism of the motor 1121 includes a fixing member 1131 sleeved on the motor 1121 and an electric heating wire 1132 connected with the fixing member 1131. The electric heating wire 1132 is used to heat the airflow in the housing 111 and transport it to the front end of the housing 111.

Referring to FIG. 4 and FIG. 5, the air cylinder shell 131 has an air inlet 114 and an air outlet 115 disposed opposite to each other. Accordingly, the fan 1122 is disposed adjacent to the air inlet 114. The electric heating mechanism 113 is disposed adjacent to the air outlet 115. In order to isolate external impurities and improve the diversion effect of incoming and outgoing air, the air cylinder 11 further includes an air inlet net 1141 arranged at the air inlet 114 and an air outlet net 1151 arranged at the air outlet 115. Both the air inlet net 1141 and the air outlet net 1151 include an annular support and a mesh body arranged inside the annular support. The mesh body of the air inlet net 1141 protrudes beyond the outside of the annular support along a direction opposite to a wind direction. The mesh body of the air outlet net 1151 protrudes beyond the annular support in the direction opposite to the wind direction. In order to achieve the purpose of reducing wind resistance, the middle of the mesh body of the air inlet net 1141 and the air outlet net 1151 is set as a ring-shaped central connection point. In order to further improve the filtering effect at the air inlet 114, a filter element 1142 is also provided at the air inlet 114. The filter element 1142 is connected to the housing 111 and is disposed adjacent to the fan 1122.

Referring to FIG. 7, FIG. 8 and FIG. 9, the handle portion 12 includes a main control assembly 121 arranged in the handle shell 132 and a switch assembly 122 arranged on the handle shell 132. The main control assembly 121 is disposed on the inner support 133 and is electrically connected to the air cylinder 11. The main control assembly 121 may be in a form of a printed circuit board or the like, and is fixed on the inner support 133 by fasteners. The present disclosure does not make specific limitations here, and it depends on the actual situation. The switch assembly 122 is electrically connected to the main control assembly 121. The switch assembly 122 can be a switch button, and can also include a temperature adjustment button or push button, a speed adjustment button or a push button. By pressing the switch button, the electronic contacts on the switch are connected with the electronic contacts on the main control assembly 121, so that the main control assembly 121 controls the motor 1121 and/or the electric heating wire 1132 to be turned on or off. By pressing or pushing or pulling the speed adjustment button or the push button, the electronic contacts on it are in contact with the electronic contacts on the main control assembly 121, so that the main control gradually controls the speed of the motor 1121, thereby realizing the adjustment of the wind speed.

Referring to FIG. 8, the hair dryer 1100 further includes an electric wire assembly 123. At least part of the electric wire assembly 123 is disposed in the shell assembly 13 of the hair dryer, and is electrically connected with the main control assembly 121, the switch assembly 122 and the air cylinder 11. The electric wire assembly 123 includes wires. The above-mentioned main control assembly 121 is electrically connected to the motor 1121 and the electric heating wire 1132 through the wires, so as to control the operation of the two. Correspondingly, a hole 1313 is also provided on the air cylinder shell 131 of the air cylinder for allowing the wires to pass through. As mentioned above, the hole 1313, the first working hole 1311 and the second working hole 1312 are arranged in the middle of the side wall of the air cylinder shell 131, so as to improve the overall aesthetics of the hair dryer 1100.

Referring to FIG. 10, in order to enable the wind blown out by the hair dryer 1100 to be blown out in a specific direction, the hair dryer 1100 further includes an air nozzle 14 which is detachably connected to the air cylinder shell 131 of the hair dryer. The air nozzle 14 includes a connecting body 141 and a nozzle body 142 which are connected in sequence. The connecting body 141 is installed at the air outlet 115. The nozzle body 142 can be set to a specific shape to obtain a specific wind direction. An inner cavity structure of the connecting body 141 can be set so that the outlet air can be smoothly guided to the nozzle body 142. In this embodiment, the nozzle body 142 may be configured as a flat cavity. Of course, in other embodiments, the nozzle body 142 can also be of other shapes. This disclosure does not make specific limitations here, and it depends on the actual situation.

The shapes of the first working hole 1311 and the second working hole 1312 are determined according to actual conditions. Correspondingly, the shape of the protrusion 1322 also needs to be changed accordingly. The above-mentioned first fastener, the second fastener and the third fastener may be screws, fastening pins, etc., which are not specifically limited here, and are determined according to actual conditions.

In summary, by setting the inner support 133 and the air cylinder shell 131 to be detachably connected, after the air cylinder 11 and the air cylinder shell 131 are fixedly connected, the inner support 133 is first connected with the air cylinder shell 131 and then directly mated with the air cylinder shell 131. This ensures that the installation position of the inner support 133 is not offset, thereby ensuring that the installation position of the handle shell is not offset, the installation is fast and convenient, and at the same time, it is easy to control.

The handle shell 132 is provided with a protrusion 1322 which is engaged with the air cylinder shell 131. When the protrusion 1322 passes through the air cylinder shell 131 to be fastened and fixed with the air cylinder shell 131, the end surface of the handle shell 132 abuts against the air cylinder shell 131. This does not need to be installed and fixed by screws, which is fast and convenient, and also improves the aesthetics and integrity of the overall appearance of the hair dryer 1100.

Both the air cylinder shell 131 and the handle shell 132 are integrally formed, and the air cylinder shell 131 and/or the handle shell 132 are made of metal. While improving the aesthetics of the overall appearance of the hair dryer 1100, the overall texture of the hair dryer 1100 is also improved, and the user experience is improved.

The technical features of the above-described embodiments can be combined arbitrarily. In order to simplify the description, all possible combinations of the technical features in the above embodiments are not described. However, as long as there is no contradiction in the combination of these technical features, they should be considered to be within the scope of the description in this specification.

The above-mentioned embodiments only represent several embodiments of the present disclosure, and the descriptions thereof are specific and detailed, but should not be construed as a limitation on the scope of the invention. It should be pointed out that for those of ordinary skill in the art, without departing from the concept of the present disclosure, several modifications and improvements can also be made, which all belong to the protection scope of the present disclosure. Therefore, the protection scope of the patent of the present disclosure should be subject to the appended claims.

The air cylinder of the hair dryer and the handle are connected by assembling. The design of the connection structure between the air cylinder and the handle of the hair dryer on the market is unreasonable, and there are problems of poor connection stability and reliability, and it is not easy to assemble. This greatly affects the performance and appearance of the hair dryer. In view of this, the present disclosure provides a hair dryer. FIG. 11 to FIG. 25 show an embodiment of the hair dryer provided by the present disclosure.

Figure 14:
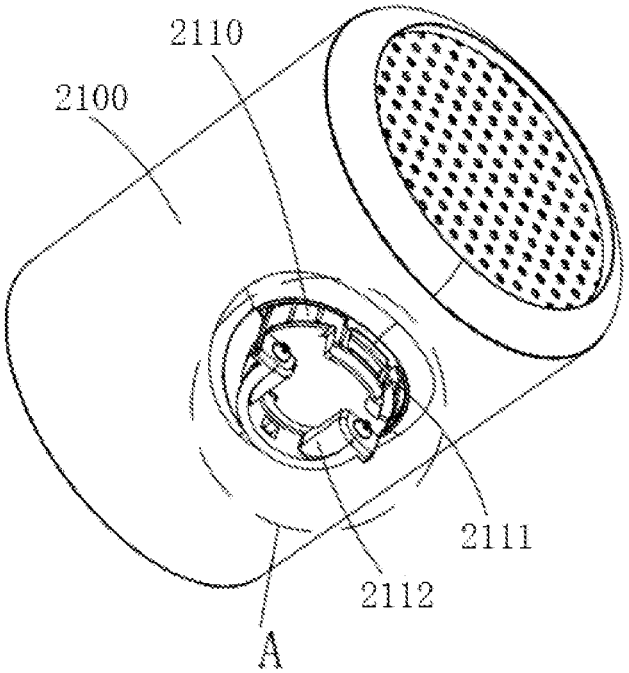
FIG. 14 is a structural schematic view of a mounting rib plate in the present disclosure.
Figure 17:
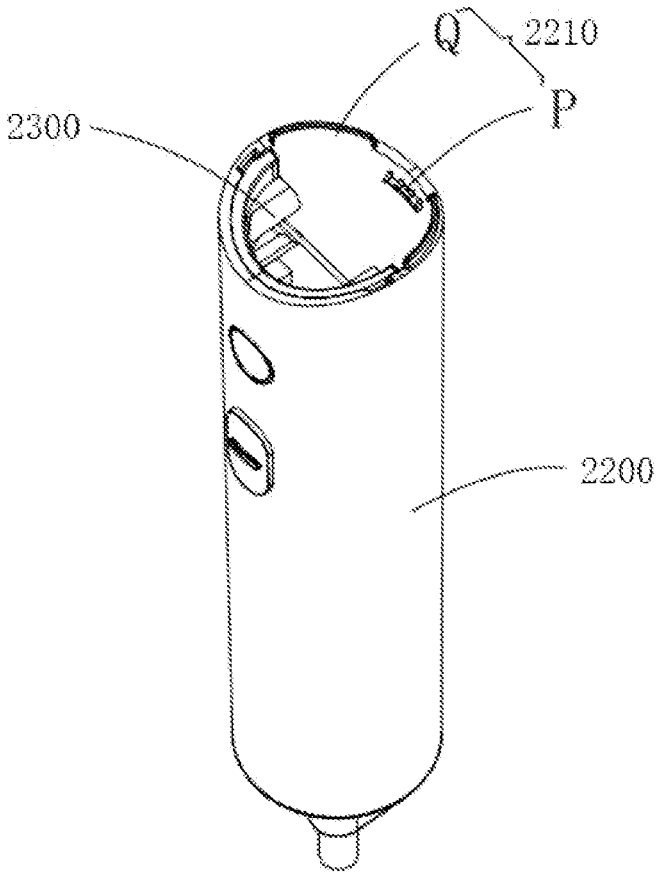
FIG. 17 is a schematic view of a shell snap structure in the present disclosure.
Figure 18:
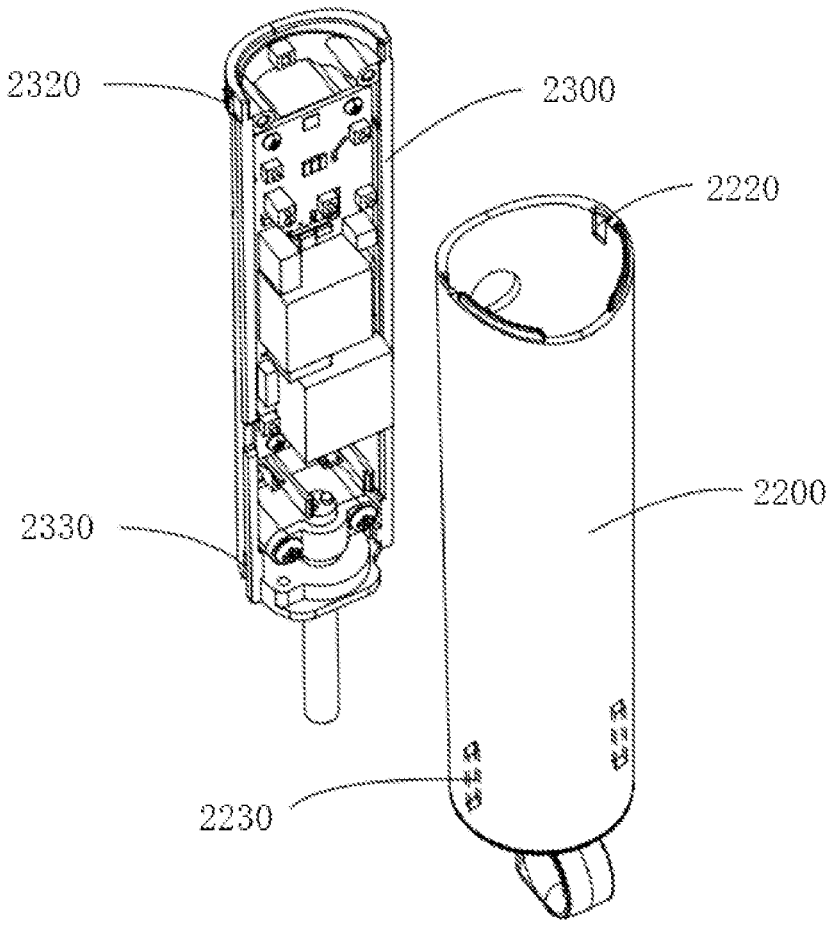
FIG. 18 is an exploded schematic view of a handle shell and a handle inner frame in the present disclosure.

Referring to FIG. 14 and FIG. 17, in an embodiment, the hair dryer includes: an air cylinder 2100 and a handle assembly which is disposed below the air cylinder 2100. The handle assembly includes a handle shell 2200 which is detachably disposed on the air cylinder 2100. A communication port 2120 is provided on an outer side wall of the air cylinder 2100. A mounting rib plate 2110 is distributed in a circumferential direction of the communication port 2120. The mounting rib plate 2110 is configured to connect the handle assembly. The mounting rib plate 2110 is provided with an air cylinder snap structure 2111. A top of the handle shell 2200 is provided with a shell snap structure 2210. The shell snap structure 2210 is configured to cooperate with the air cylinder snap structure 2111, so as to achieve circumferential positioning and axial snapping between the air cylinder 2100 and the handle shell 2200.

In the above manner, the handle shell 2200 in the present disclosure can be installed at the communication port 2120 of the air cylinder 2100 through the cooperation between the shell snap structure 2210 and the air cylinder snap structure 2111. During the mating process of the shell snap structure 2210 and the air cylinder snap structure 2111, circumferential positioning and axial snap-fit between the air cylinder 2100 and the handle shell 2200 can be achieved. Therefore, the connection between the air cylinder 2100 and the handle shell 2200 in the present disclosure is stable and reliable, and the installation is convenient.

Figure 15:
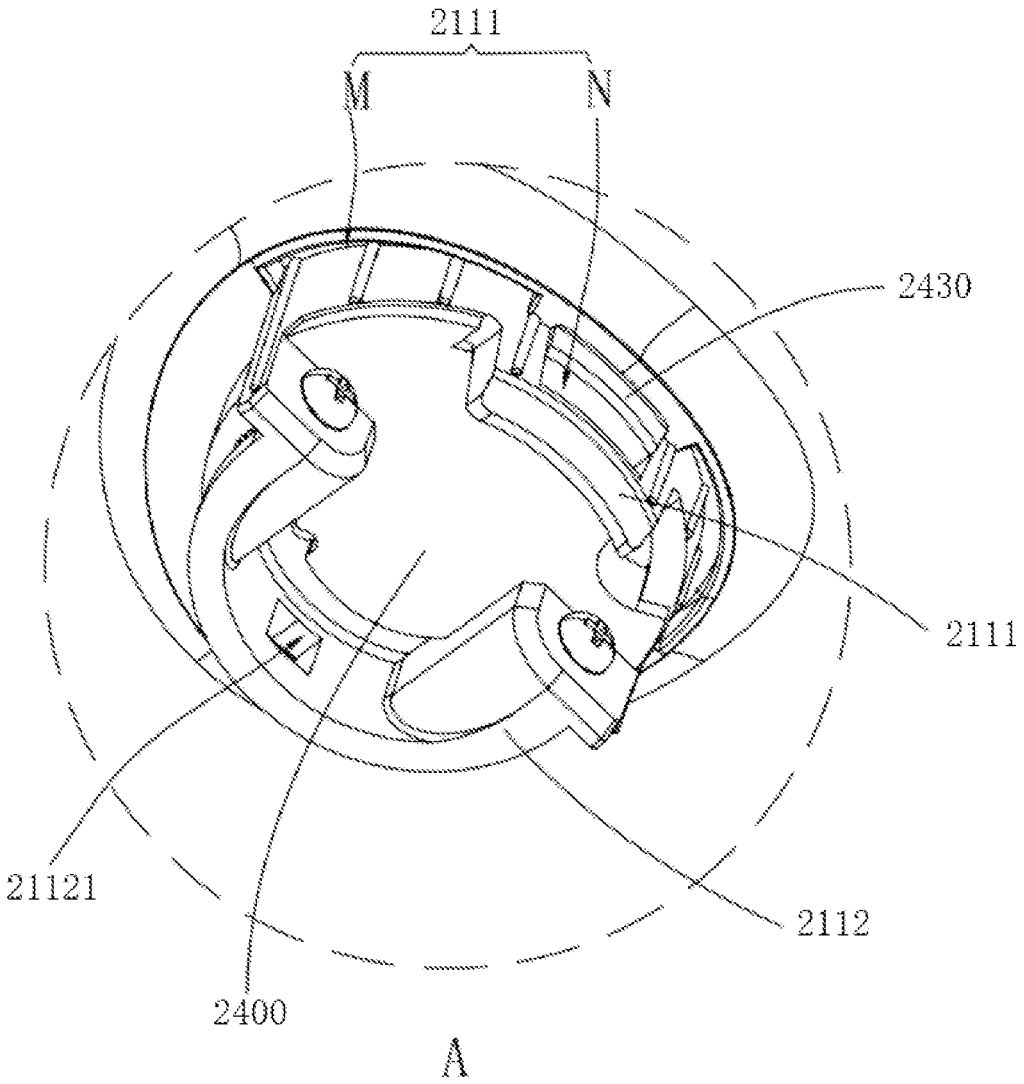
FIG. 15 is a schematic view of a positional relationship between the mounting rib plate and a sealing member in the present disclosure.

In an embodiment, the air cylinder snap structure 2111 includes an insertion slot M and a snap slot N formed on the mounting rib plate 2110. The shell snap structure 2210 includes an insertion block Q and a buckle P arranged on the top of the handle shell 2200. Wherein, the insertion block Q is matched with the insertion slot M, and the buckle P is matched with the snap slot N. Referring to FIG. 15 and FIG. 17, the insertion slot M is located at the root of the mounting rib plate 2110. The root refers to the connection between the mounting rib plate 2110 and the air cylinder 2100. The insertion slot M is arc-shaped, and can realize the circumferential positioning of the handle shell 2200 after being matched with the insertion block Q. The snap slot N is located on the circumferential side wall of the mounting rib plate 2110, and after engaging with the buckle P, the axial snap connection of the air cylinder 2100 and the handle shell 2200 can be realized. Therefore, the installation and connection of the air cylinder 2100 and the handle shell 2200 can be conveniently completed, the installation accuracy is high, and the reliability and stability of the connection are also good. It can be understood that, the air cylinder snap structure 2111 may also include an insertion block Q1 and a buckle P1 formed on the mounting rib plate 2110. The shell snap structure 2210 correspondingly includes an insertion slot M1 and a snap slot N1 provided on the top of the handle shell 2200. The specific setting method can be determined according to the actual installation situation.

Considering that the existing handle shell is combined of two half shells of roughly the same size, and the outside is fixed with screws, in the hair dryer with this structure, the exposed screws are easily rusted by the influence of the external humid environment. Exposed screw holes cause an unsightly appearance. In view of this, the handle assembly in the present disclosure includes a handle shell 2200 and a handle inner frame 2300 supporting an electronic control component. The handle shell 2200 is an elongated cylinder with a hollow interior and a generally cylindrical shape. The handle inner frame 2300 is built in the handle shell 2200. Referring to FIG. 17 to FIG. 20, the handle inner frame 2300 is a semi-cylindrical frame body.

The handle inner frame 2300 is detachably disposed in the handle shell 2200. An inner space of the handle shell 2200 is divided into a first semi-cylindrical area and a second semi-cylindrical area. The handle inner frame 2300 is located in the second semi-cylindrical area. The shell snap structure 2210 is located in the first semi-cylindrical area.

Further, in order to improve the connection strength and the centering of the handle assembly and the air cylinder 2100, the top of the handle inner frame 2300 is provided with an inner frame central fastening structure 2310. The mounting rib plate 2110 is also provided with an air cylinder central fastening structure 2112 which is matched with the inner frame central fastening structure 2310. The handle inner frame 2300 is connected to the air cylinder 2100 through the matching relationship between the inner frame central fastening structure 2310 and the air cylinder central fastening structure 2112, thereby effectively improving the connection strength and centering of the handle assembly and the air cylinder 2100.

Figure 19:
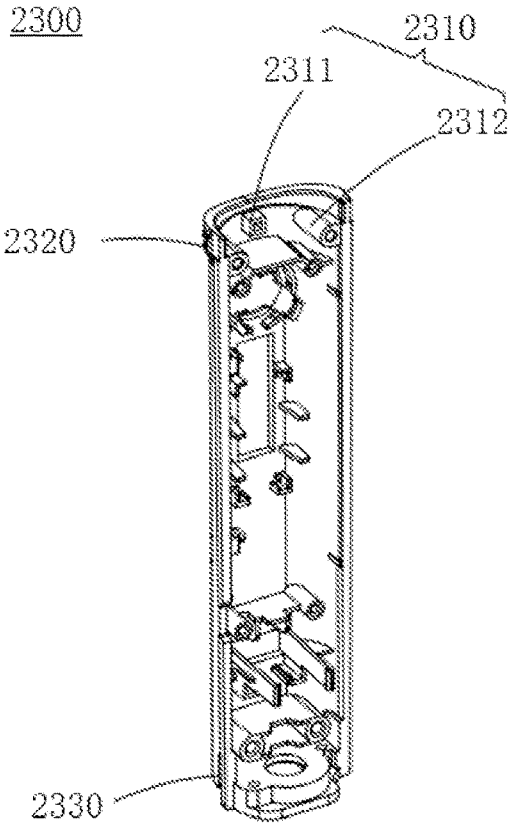
FIG. 19 is a structural schematic view of the handle inner frame in the present disclosure.

Specifically, referring to FIG. 15 and FIG. 19, the air cylinder central fastening structure 2112 includes a central positioning hole 21121 formed in the mounting rib plate 2110. The inner frame central fastening structure 2310 includes a central positioning post 2311 and first hole posts 2312 which are disposed on the handle inner frame 2300 and distributed along the axial direction perpendicular to the handle shell 2200. The central positioning hole 21121 and the central positioning post 2311 are respectively located on symmetrical planes of the air cylinder 2100 and the handle assembly to ensure the centering. The central positioning post 2311 is matched with the central positioning hole 21121. The first hole posts 2312 are symmetrically arranged on both sides of the central positioning post 2311. The first hole post 2312 is configured to screw the air cylinder 2100 and the handle inner frame 2300. During installation, firstly, the central positioning post 2311 is inserted into the central positioning hole 21121 to achieve the centering of the air cylinder 2100 and the handle assembly; and then, the handle inner frame 2300 is fastened on the mounting rib plate 2110 by screws, so as to realize the connection between the handle assembly and the air cylinder 2100. The mounting rib plate 2110 is also formed with threaded holes for the screws to pass through. The screws are threadedly connected to the first hole posts 2312 after passing through the threaded holes.

In order to make the handle assembly and the air cylinder 2100 have better centering, the central positioning post 2311 is set as a square cylinder. The central positioning hole 21121 is arranged in the shape of a square hole matched with the central positioning post 2311.

In an embodiment, the handle shell 2200 and the handle inner frame 2300 are detachably connected through a circumferential positioning structure and an end surface positioning and fastening structure. The circumferential positioning structure is located on the top and bottom of the handle assembly. The end face positioning and fastening structure is located at the bottom of the handle assembly. Therefore, the assembly of the handle shell 2200 and the handle inner frame 2300 can be facilitated, and the connection reliability and stability between the handle shell 2200 and the handle inner frame 2300 can be effectively improved.

Specifically, the circumferential positioning structure is composed of a top circumferential positioning substructure and a bottom circumferential positioning substructure. Referring to FIG. 18 to FIG. 22, the top circumferential positioning substructure includes a first positioning groove 2220 disposed on the top inner wall of the handle shell 2200 and a first positioning block 2320 disposed on the top outer wall of the handle inner frame 2300. During assembly, only the first positioning block 2320 is correspondingly snapped into the first positioning groove 2220 to realize the circumferential positioning on the top. In the present disclosure, the first positioning block 2320 and the first positioning groove 2220 are provided in a one-to-one correspondence. The number of the first positioning blocks 2320 and the first positioning grooves 2220 is two, respectively. The bottom circumferential positioning substructure includes a second positioning block 2230 disposed on the bottom inner wall of the handle shell 2200 and a second positioning groove 2330 disposed on the bottom outer wall of the handle inner frame 2300. During assembly, only the second positioning block 2230 is correspondingly snapped into the second positioning groove 2330 to realize the circumferential positioning at the bottom. In the present disclosure, the second positioning block 2230 and the second positioning groove 2330 are provided in a one-to-one correspondence. The number of the second positioning blocks 2230 and the second positioning grooves 2330 is two, respectively. Therefore, the assembling accuracy and assembling efficiency can be effectively improved, and the installation is quick and convenient.

Figure 20:
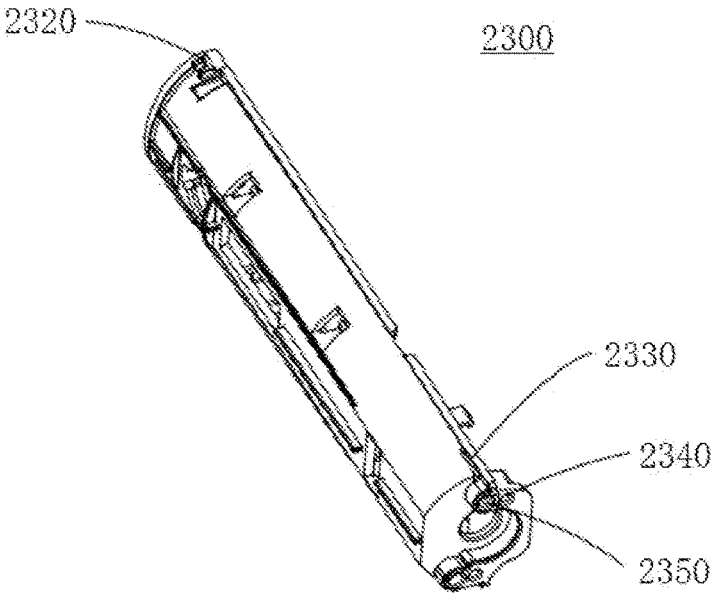
FIG. 20 is a schematic view of the handle inner frame in a bottom view direction of the present disclosure.
Figure 21:
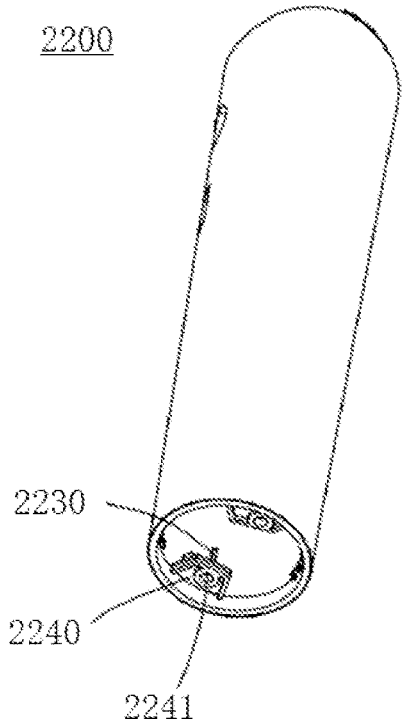
FIG. 21 is a schematic view of the handle shell in a bottom view direction of the present disclosure.
Figure 22:
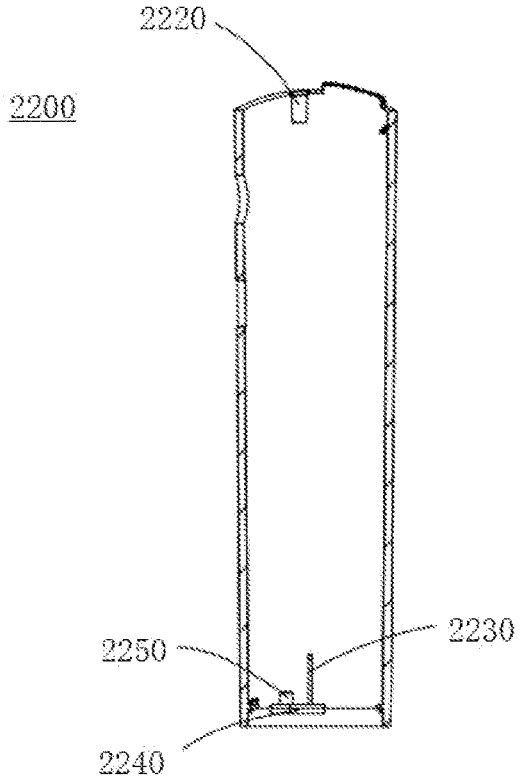
FIG. 22 is a cross-sectional schematic view of the handle shell in the present disclosure.

Specifically, referring to FIG. 20 to FIG. 22, the end surface positioning and fastening structure includes a second protrusion 2240 located at the inner bottom of the handle shell 2200, a second hole post 2340 and an end surface positioning hole 2350 formed on the bottom end surface of the handle inner frame 2300. The second protrusion 2240 is fixed on the inner side wall of the handle shell 2200 and distributed along the radial direction of the handle shell 2200. The second protrusion 2240 is provided with a through hole 2241 for the screw to pass through to the second hole post 2340, and an end surface positioning post 2250 distributed along the axial direction of the handle shell 2200 for matching with the end surface positioning hole 2350. As a result, the axial connection between the handle shell 2200 and the handle inner frame 2300 can be realized, and the installation is convenient and reliable.

In an embodiment, referring to FIG. 11 to FIG. 16, an interior of the air cylinder 2100 is hollow along its axial direction to form an air channel for flow of air. The communication port 2120 is located at the connection between the air cylinder 2100 and the handle assembly, and is used for connecting the air cylinder 2100 and the handle assembly. A sealing member 2400 is provided at the communication port 2120. The sealing member 2400 is configured to prevent the airflow in the air channel from entering the handle assembly, and is provided with a wiring structure for the cable in the handle assembly to pass through to the air cylinder 2100.

In the above manner, the sealing member 2400 in the present disclosure is blocked at the communication port 2120, which effectively isolates the air cylinder 2100 and the handle assembly, and can prevent the airflow in the air cylinder 2100 from entering the handle assembly. Therefore, the loss of air volume in the air cylinder 2100 is avoided, and the air tightness between the air cylinder 2100 and the handle assembly is significantly improved. The wiring structure on the sealing member 2400 enables the cable in the handle assembly to pass through to the air cylinder 2100. While ensuring airtightness, the wiring between the air cylinder 2100 and the handle assembly is also ensured.

In an embodiment, considering that most of the space inside the air cylinder 2100 is used for installing a motor, a fan wheel and a heating wire assembly, there are fewer electronic control components. A main electronic control board is installed in the handle assembly. Multiple cables in the handle assembly need to be connected to the air cylinder 2100 from the electric control board in the handle assembly, so as to realize the power supply and control of the motor and the heating wire assembly. In view of this, the wiring structure is at least one wiring hole 2410 formed on the sealing member 2400. The wiring holes 2410 are arranged at intervals. The above-mentioned wiring holes 2410 are used to organize the multiple cables from the handle assembly to the inside of the air cylinder 2100, so as to distinguish the cables that can generate high voltage from the cables that can generate low voltage. As a result, the electromagnetic interference problem caused by the passage of multiple cables through a single wiring hole 2410 is avoided.

Figure 23:
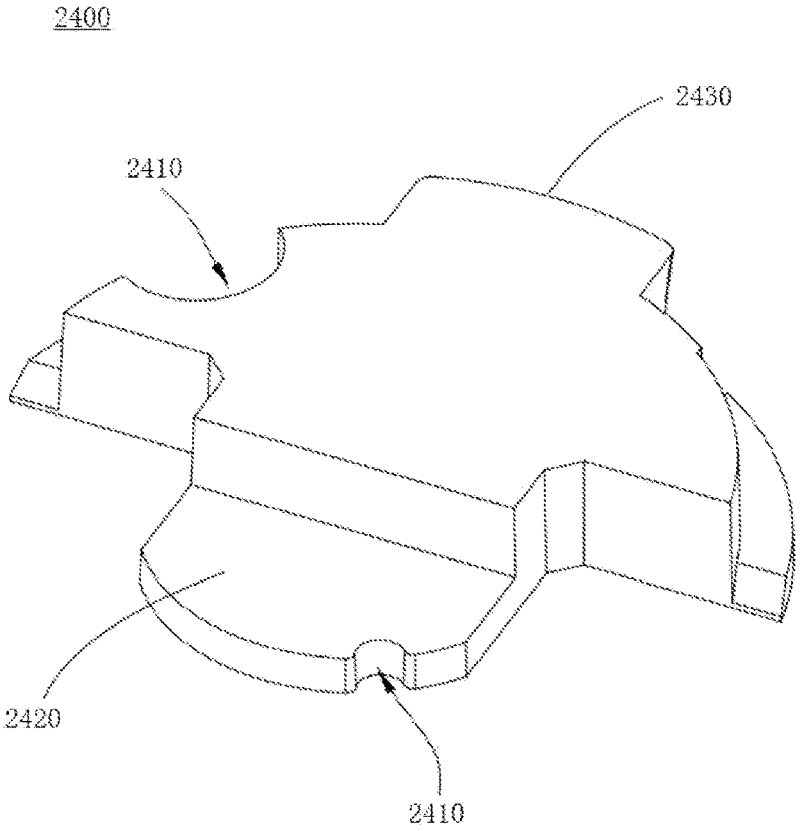
FIG. 23 is a schematic view of an embodiment of the sealing member in the present disclosure.
Figure 24:
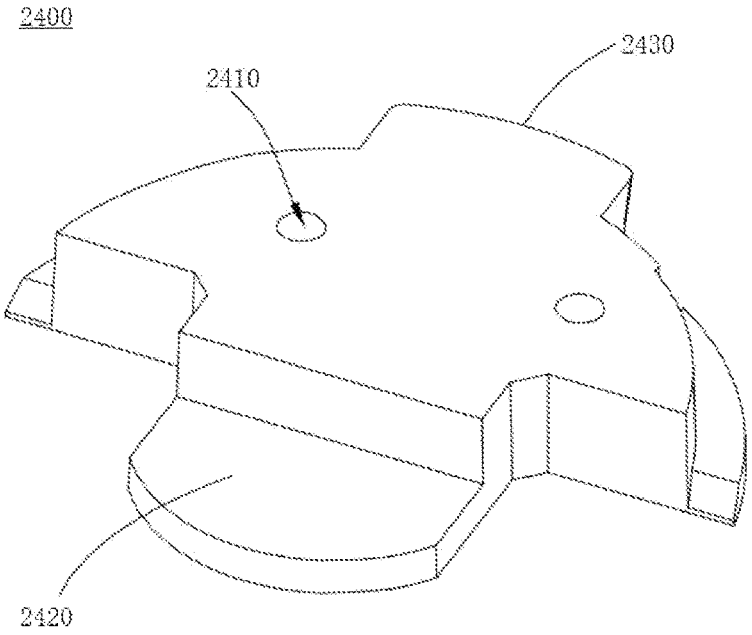
FIG. 24 is a schematic view of the sealing member in another embodiment of the present disclosure.

It can be understood that, referring to FIG. 23 and FIG. 24, the wiring hole 2410 is a through hole formed on the sealing member 2400. Alternatively, the wiring hole 2410 is a hole-shaped area formed by a groove body formed at an edge of the sealing member 2400 and a hole wall of the communication port 2120, which will not be repeated here.

In an embodiment, the sealing member 2400 is a flexible soft member, which has good elastic deformation ability, and can cooperate well with the communication port 2120 to improve the air tightness between the air cylinder 2100 and the handle assembly. The sealing member 2400 may be made of flexible materials such as rubber or silicone. During installation, the sealing member 2400 is directly snapped at the communication port 2120. The contact surface between the sealing member 2400 and the communication port 2120 is an interference fit, which has the advantages of stable and reliable connection.

Figure 16:
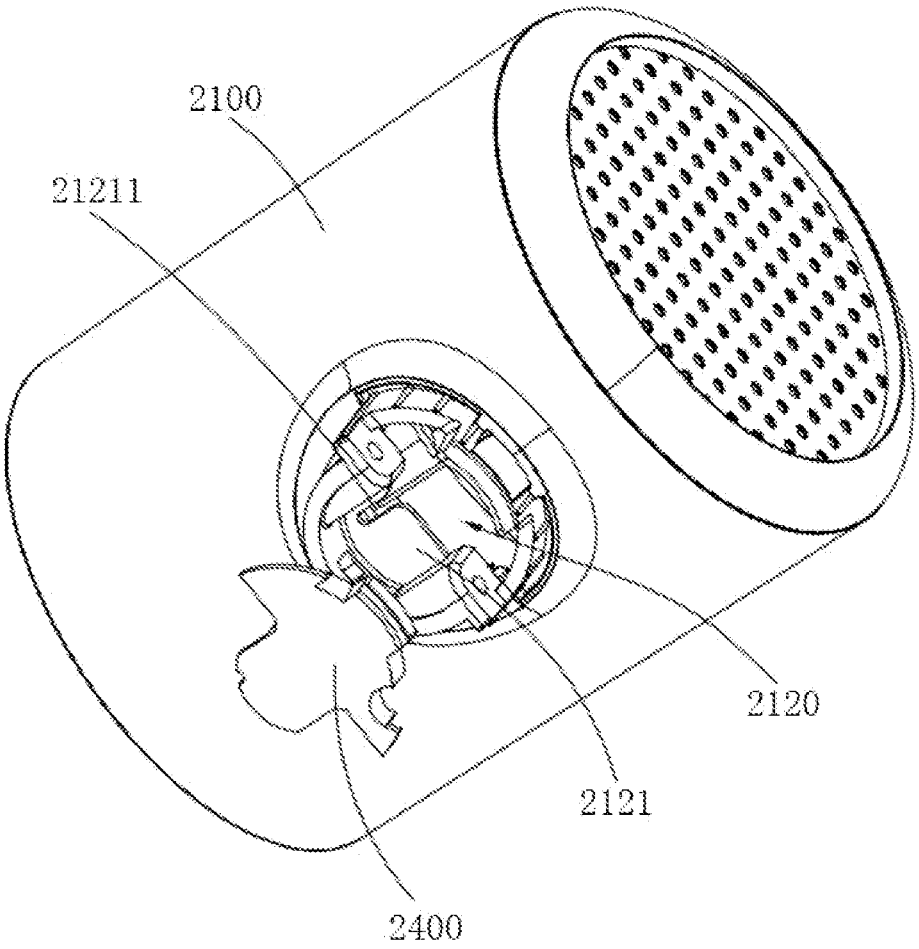
FIG. 16 is an exploded schematic view between the air cylinder and the sealing member in the present disclosure.

Further, considering the positioning problem of the sealing member 2400 in the axial direction, a convex rib 2121 growing along the radial direction is fixed on the inner wall of the communication port 2120. Referring to FIG. 16 and FIG. 23, the convex rib 2121 is configured to realize the locking of the sealing member 2400 in the axial direction of the communication port 2120. The sealing member 2400 is formed with a limiting flange 2420 which is snapped with the convex rib 2121. In this way, the axial positioning of the sealing member 2400 can be realized, which has the advantages of convenient installation and in-place installation.

In an embodiment, the cable connecting a negative ion generator and an emitting needle is a cable capable of generating high voltage, which is referred to as a high-voltage cable herein. The negative ion generator is arranged in the handle assembly. The emitting needle is located inside the air cylinder 2100. In order to ensure the accuracy of the position of the emitting needle, the stability of the high-voltage cable must be ensured. Please continue to refer to FIG. 16 and FIG. 23, the limiting flange 2420 has a wiring hole 2410. A wiring groove 21211 is provided on the convex rib 2121. The wiring groove 21211 correspond to the above-mentioned wiring hole 2410. Projections of the wiring groove 21211 and the wiring hole 2410 on the limiting flange 2420 in the axial direction of the communication port 2120 overlap. The convex rib 2121 is made of hard material. The wiring groove 21211 on the convex rib 2121 can have a clamping function for the high-voltage cable, so as to make the high-voltage cable move stably.

Further, referring to FIG. 15, an extension block 2430 is disposed at the edge of the sealing member 2400 and can be snapped into the snap slot N. After the buckle P is snapped into the snap slot N, the buckle P can support the extension block 2430 from the bottom. As a result, the buckle P can support the extension block 2430, and to a certain extent, the sealing member 2400 can be prevented from falling.

Figure 13:
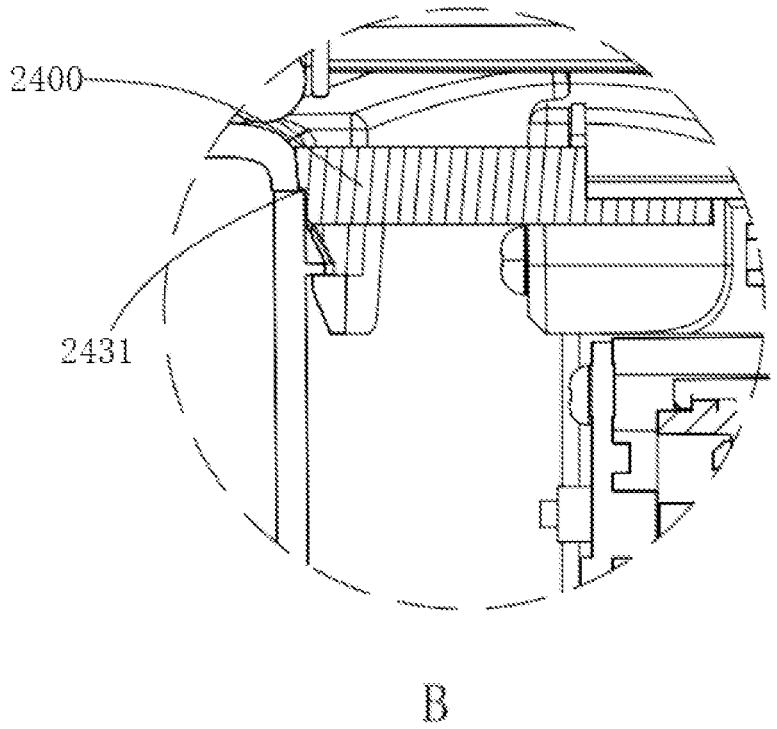
FIG. 13 is an enlarged structural schematic view of an area B in FIG. 12.
Figure 25:
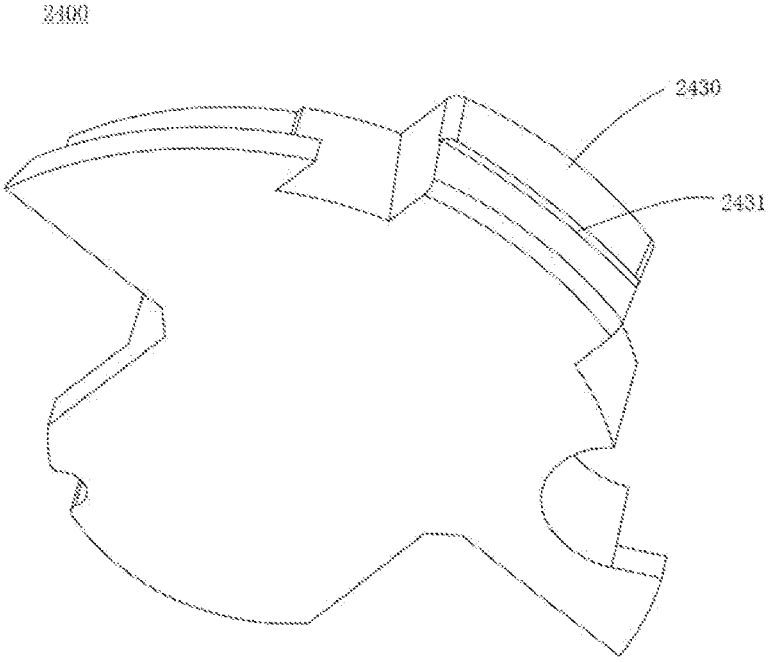
FIG. 25 is a structural schematic view of the sealing member in the present disclosure.
Figure 26:
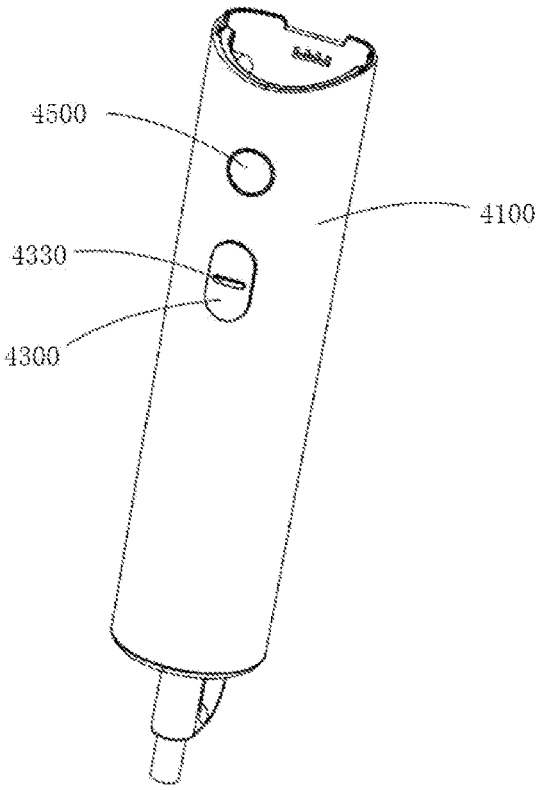
FIG. 26 is a structural schematic view of the handle in the present disclosure.

Further, referring to FIG. 13 and FIG. 25, a step portion is provided on the side wall of the extension block 2430 to form a shoulder 2431 which is snapped with the top edge of the handle shell 2200. Therefore, the sealing member 2400 can be effectively positioned in the axial direction of the handle shell 2200, and has the advantages of stable and reliable connection.

In summary, the handle shell in the present disclosure can be installed at the communication port of the air cylinder through the cooperation between the shell snap structure and the air cylinder snap structure. During the mating process of the shell snap structure and the air cylinder snap structure, the circumferential positioning and the axial snapping between the air cylinder and the handle shell can be realized. Therefore, the connection between the air cylinder and the handle shell in the present disclosure is stable and reliable, and the installation is convenient. Further, the handle inner frame is connected to the air cylinder through the matching relationship between the inner frame central fastening structure and the air cylinder central fastening structure, thereby effectively improving the connection strength and centering of the handle assembly and the air cylinder. The detachable connection is achieved between the handle shell and the handle inner frame through the circumferential positioning structure and the end surface positioning and fastening structure. Thereby, the assembly of the handle shell and the handle inner frame can be facilitated, and the connection reliability and stability between the handle shell and the handle inner frame can be effectively improved. Further, in the present disclosure, the airflow in the air cylinder can be prevented from entering the handle assembly by blocking the sealing member at the communication port. Therefore, the loss of air volume in the air cylinder is avoided, and the air tightness between the air cylinder and the handle assembly is significantly improved.

Although the embodiments of the present disclosure have been disclosed above, they are not limited to the applications listed in the description and the embodiments, and can be applied to various fields suitable for the present disclosure. Additional modifications can readily be implemented by those skilled in the art. Therefore, the present disclosure is not limited to the specific details and illustrations shown and described herein without departing from the general concept defined by the claims and the scope of equivalents.

The hair dryer includes a blower and a handle disposed below the blower for supporting the blower. A push button assembly is provided on the handle. The push button assembly has the functions of turning on or off the blower, and adjusting the blowing speed of the blower. The installation structure of the push button assembly on the market has the defects of complex structure and inconvenient installation.

In view of this, the present disclosure provides a push button assembly. Referring to FIG. 26 to FIG. 42, the push button assembly is applied to a hair dryer handle 4100 with an adjustment switch 4200 inside. The push button assembly includes a push button 4300 and a sliding member 4400. The push button 4300 is disposed outside the handle 4100. The push button 4300 has a first snap structure extending to an inside of the handle 4100. The sliding member 4400 is disposed inside the handle 4100 and has a second snap structure. The sliding member 4400 is configured to connect the push button 4300 and the adjustment switch 4200. The push button 4300 is snapped to the sliding member 4400 through the cooperation between the first snap structure and the second snap structure, so as to push a trigger portion 4210 on the adjustment switch 4200 to slide linearly in the axial direction of the handle 4100.

In the above manner, the push button 4300 in the present disclosure is snapped to the sliding member 4400 through the cooperation between the first snap structure and the second snap structure, so as to realize the gear adjustment of the adjustment switch 4200. It has the advantages of simple structure and convenient installation.

In this embodiment, the handle 4100 includes a handle shell 4110 and a handle inner frame 4120. The inside of the handle shell 4110 is hollow along its axial direction to form an accommodating cavity. The handle inner frame 4120 is detachably disposed in the accommodating cavity, and supports the electric control board. An adjustment switch 4200 and a push switch 4800 are provided on the electric control board. The adjustment switch 4200 has the functions of turning on and off the blower and adjusting the wind speed of the blower. Turning on and off specifically refers to two states of open and closed. The speed adjustment includes two gears, which are divided into a fast gear and a slow gear.

Figure 34:
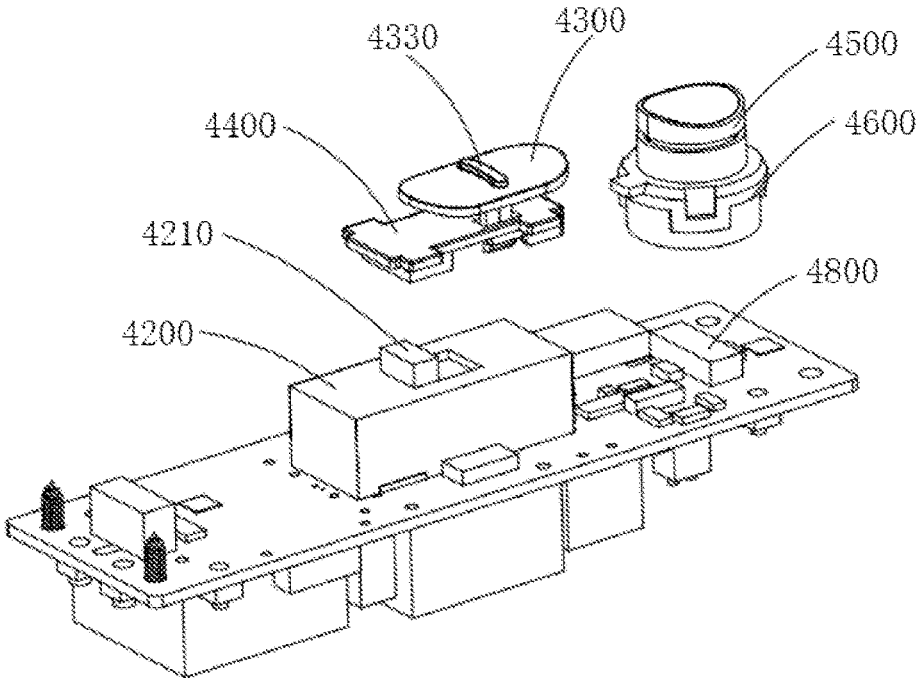
FIG. 34 is a partial exploded structural schematic view of an electric control board in the present disclosure.
Figure 35:
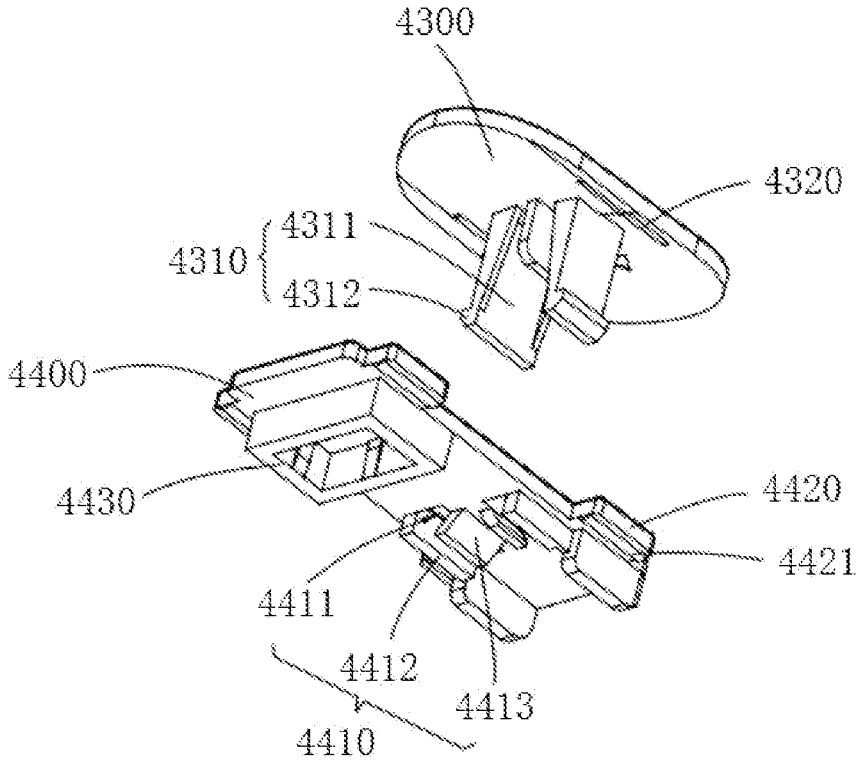
FIG. 35 is an exploded schematic view of a push button assembly in the present disclosure.
Figure 36:
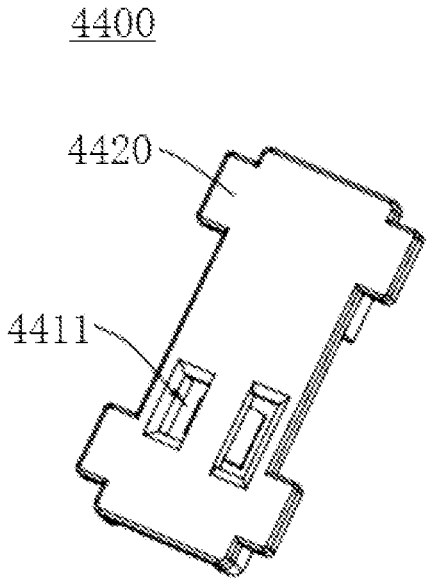
FIG. 36 is a structural schematic view of a sliding member in the present disclosure.

Further, referring to FIG. 34 and FIG. 35, the first snap structure includes a snap portion 4310, and the second snap structure includes a snap slot portion 4410. After the snap portion 4310 is snapped into the snap slot portion 4410, the push button 4300 only has a freedom of translation to move along the axial direction of the handle 4100. Therefore, the push button 4300 has a predetermined sliding trajectory, and the problem that the push button 4300 cannot slide smoothly due to shaking during movement can be avoided.

Figure 37:
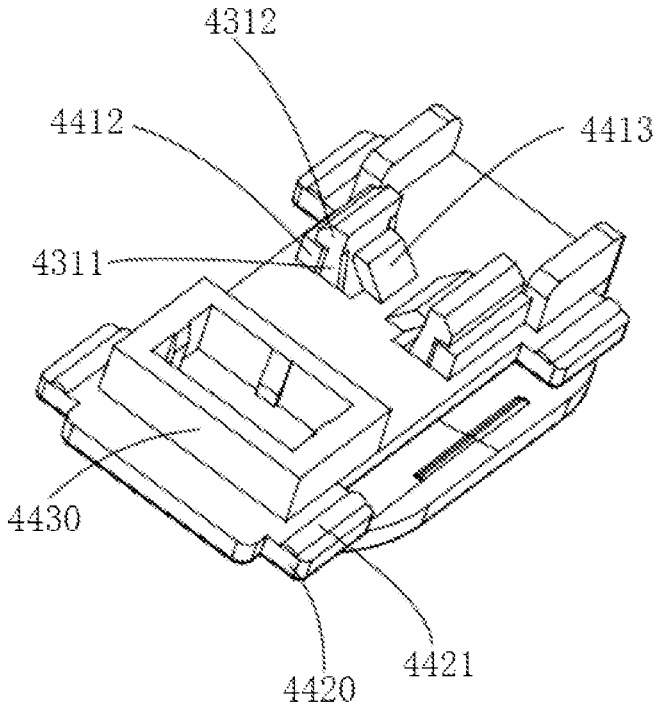
FIG. 37 is a schematic view of a positional relationship between a first stopper and a second stopper in the present disclosure.

Further, in order to improve the efficiency and accuracy of installation, referring to FIG. 37, a pair of snap portions 4310 are provided on the push button 4300, and the pair of snap portions 4310 have different widths in the axial direction of the handle 4100. As a result, since the snap portions 4310 have different sizes, the installation positions can be quickly distinguished, the efficiency and accuracy of the installation can be effectively improved, and the installation is convenient.

Specifically, referring to FIG. 35, the snap portion 4310 includes a second extension block 4311 and a buckle 4312. One end of the second extension block 4311 is fixed on the push button 4300 and grows along the axial direction perpendicular to the handle 4100. The buckle 4312 formed on the other end of the second extension block 4311. The snap slot portion 4410 includes a second through hole 4411 for the second extension block 4311 to pass through and a pair of stoppers are formed on both sides of the second through hole 4411 for locking with the snap portion 4310. The side wall of the handle 4100 is formed with a sliding slot 4150 for the second extension block 4311 to pass through and slide. The sliding slot 4150 is distributed along the axial direction of the handle 4100. The buckle 4312 is located inside the handle 4100. After the second extension block 4311 is inserted into the second through hole 4411 and the buckle 4312 is engaged with the stopper, the inner sidewall of the push button 4300 abuts against the outer sidewall of the handle 4100. In this way, the push button 4300 can only move along the axial direction of the handle 4100, so that the push button 4300 has a predetermined movement trajectory, and has the advantages of stable and reliable connection.

Considering that if the entire inner side wall of the push button 4300 abuts against the outer side wall of the handle 4100, when the push button 4300 moves, a greater frictional resistance will be generated between the push button 4300 and the outer side wall of the handle 4100. Therefore, first ribs 4320 distributed along the axial direction of the handle 4100 are provided on the inner side wall of the push button 4300. Referring to FIG. 35, the first ribs 4320 are located on opposite sides of the snap portion 4310 to reduce the contact area between the inner wall of the push button 4300 and the outer wall of the handle 4100, thereby reducing the frictional resistance when the push button 4300 moves.

Specifically, referring to FIG. 37, the stopper includes a first stopper 4412 engaged with the buckle 4312 and a second stopper 4413 inclined toward the first stopper 4412. The first stopper 4412 and the second stopper 4413 are disposed opposite to each other. After the buckle 4312 is engaged with the first stopper 4412, the second stopper 4413 abuts against the second extension block 4311, so that the second extension block 4311 abuts against the first stopper 4412. As a result, the stopper can make the connection between the push button 4300 and the sliding member 4400 more stable and reliable.

Figure 27:
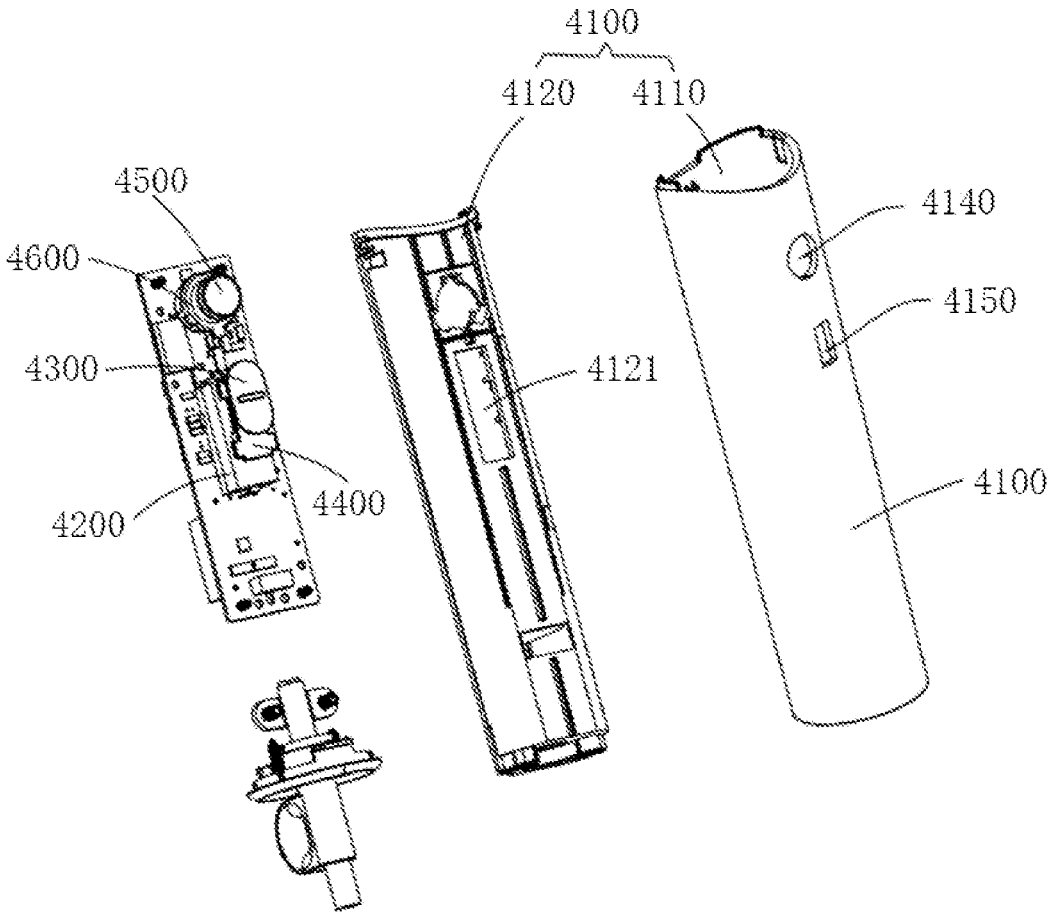
FIG. 27 is an exploded schematic view of the handle in the present disclosure.
Figure 30:
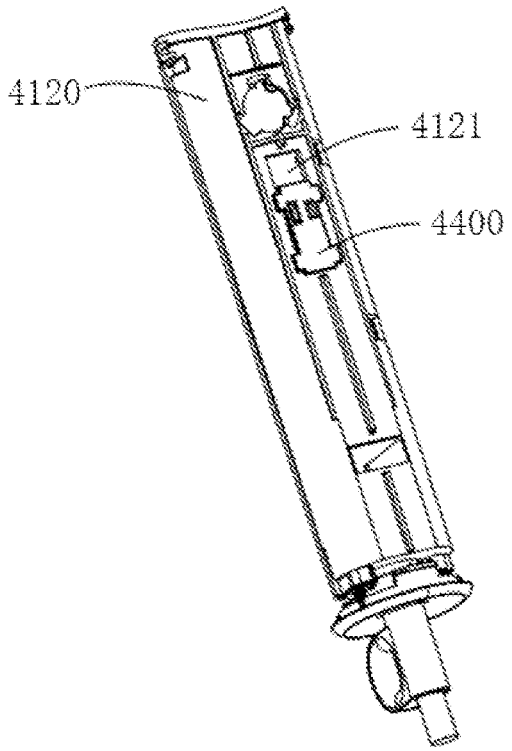
FIG. 30 is a structural schematic view of the handle inner frame in a front view direction in the present disclosure.
Figure 31:
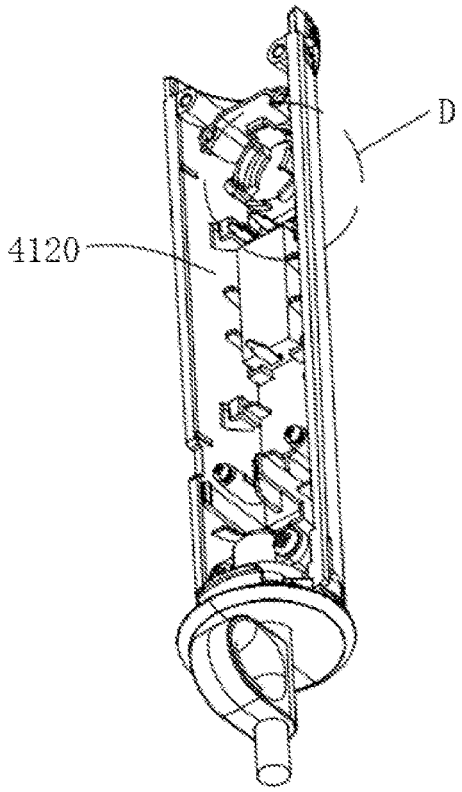
FIG. 31 is a structural schematic view of the handle inner frame in a rear view direction in the present disclosure.

Further, referring to FIG. 27 and FIG. 30, the handle inner frame 4120 is further provided with an opening 4121 matched with the sliding member 4400. A convex frame 4430 is provided on the inner side wall of the sliding member 4400 adjacent to the adjustment switch 4200. The convex frame 4430 is located in the opening 4121 and is used for connecting the trigger portion 4210. On the one hand, the opening 4121 facilitates the connection between the sliding member 4400 and the trigger portion 4210 of the adjustment switch 4200; and on the other hand, the opening 4121 can limit the sliding stroke of the sliding member 4400.

Figure 38:
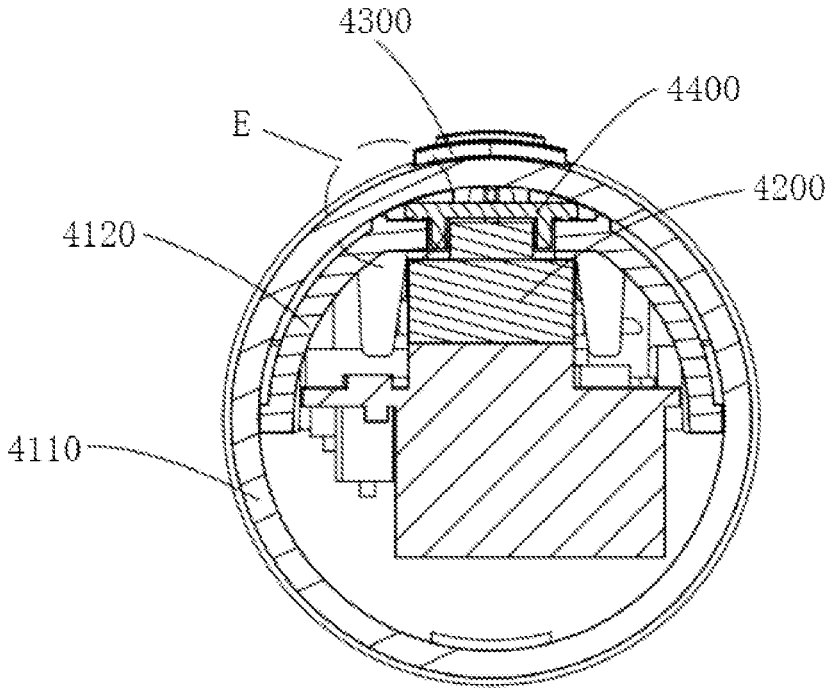
FIG. 38 is a cross-sectional schematic view between the handle inner frame and the sliding member in the present disclosure.
Figure 39:
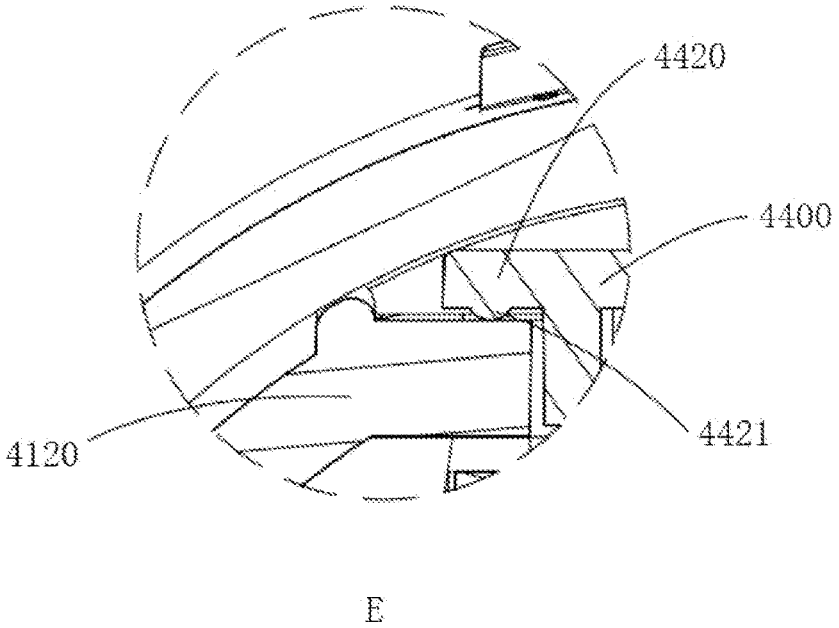
FIG. 39 is an enlarged schematic view of an area E in FIG. 38.
Figure 40:
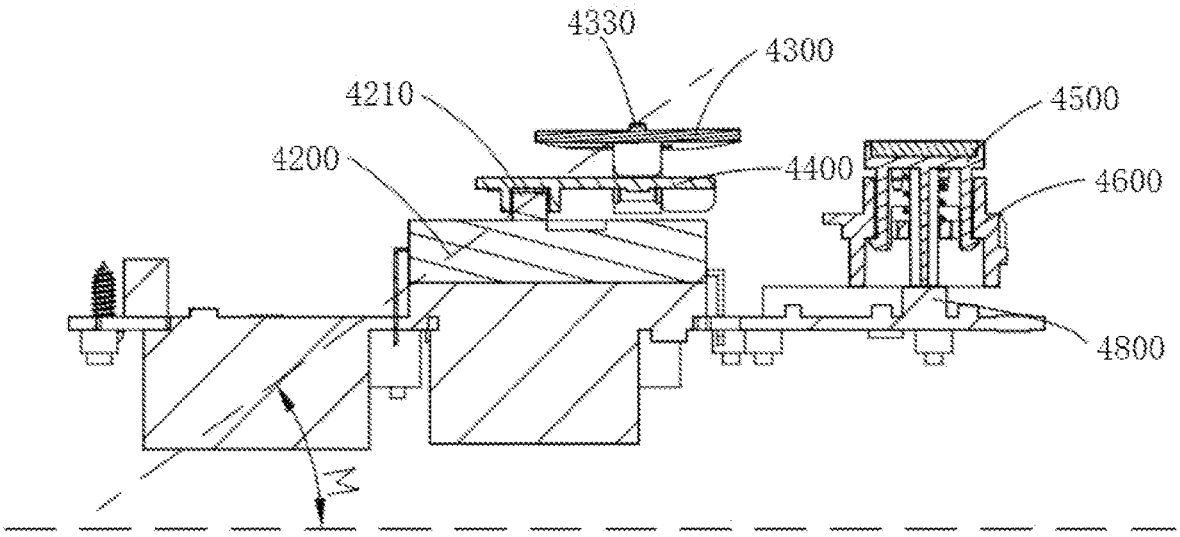
FIG. 40 is a cross-sectional schematic view of FIG. 34.

Further, in order to ensure that the sliding member 4400 has translational freedom only in the axial direction of the handle 4100 and no movement freedom in other directions, side wings 4420 are symmetrically arranged on opposite edges of the sliding member 4400. An arcuate accommodating space, which is wide in the middle and narrow on both sides, is formed between the arcuate inner wall of the handle shell 4110 and the handle inner frame 4120. Referring to FIG. 38 and FIG. 39, the above-mentioned arcuate accommodating space and the side wings 4420 can limit the sliding member 4400 to move in a width direction and a thickness direction of the opening 4121, so that the sliding member 4400 can only move in a length direction of the opening 4121. The length direction of the opening 4121 is parallel to the axial direction of the handle 4100. A second rib 4421 is also provided on the wall surface where the side wings 4420 cooperate with the handle inner frame 4120. The second rib 4421 can reduce the frictional resistance between the side wing 4420 and the handle inner frame 4120 when moving. As a result, the side wings 4420 can enable the sliding member 4400 to smoothly slide on a predetermined sliding track.

Further, in order to facilitate pushing the push button 4300, in this embodiment, the outer side wall of the push button 4300 is formed with a protruding strip 4330 which facilitates pushing the push button 4300. The protruding strip 4330 is distributed along the circumferential direction of the handle 4100. A connection line between any point on the protruding strip 4330 and any point on the trigger portion 4210 forms an included angle M with respect to the axial direction of the handle 4100. A value range of the included angle M is: 20° to 70°. The value of the included angle M can be 25°, 30°, 35°, 40°, 45°, 50°, 55°, 60° or 65°. The included angle M takes a value within the above range in order to be able to push the push button 4300 even when a small force is applied, which effectively improves the comfort of use.

Figure 28:
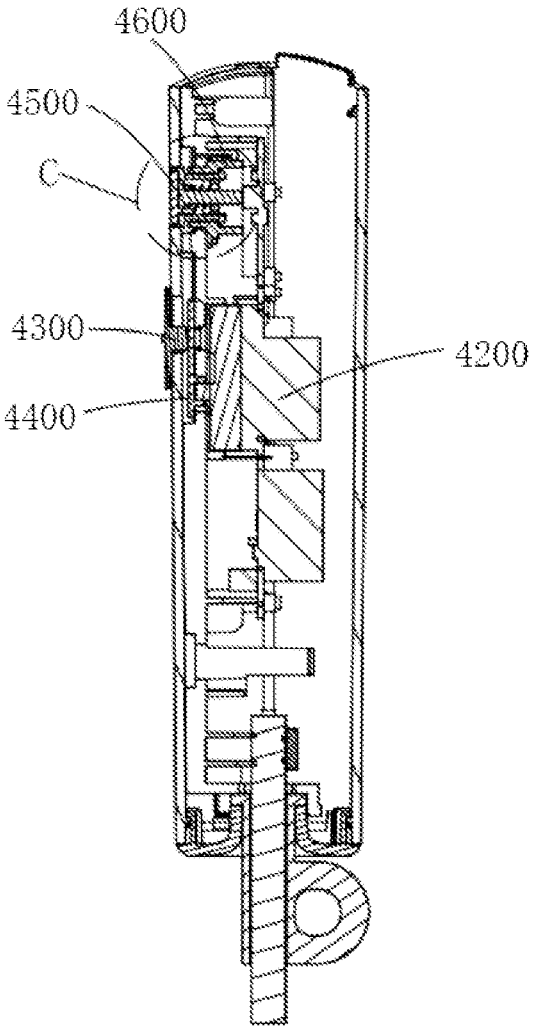
FIG. 28 is a cross-sectional schematic view of the handle in the present disclosure.

In this embodiment, the handle 4100 is also provided with a button assembly of the hair dryer. The button assembly of the hair dryer is used to switch the working state of the push switch 4800, so as to realize the adjustment of the air temperature of the hair dryer. Referring to FIG. 28 and FIG.

29, the button assembly of the hair dryer includes: a support member 4600 and a push button 4500. The support member 4600 is disposed inside the handle 4100. The support member 4600 is provided with a first connection structure 4610. The handle 4100 is provided with a second connection structure 4130 which cooperates with the first connection structure 4610. The push button 4500 is disposed on the support member 4600. The push button 4500 is provided with a locking structure 4510 to prevent it from being separated from the support member 4600. The support member 4600 is snapped to the handle 4100 through the cooperation between the first connection structure 4610 and the second connection structure 4130. After the push button 4500 is snapped to the support member 4600 through the locking structure, there are reserved gaps between the push button 4500 and the support member 4600, and between the push button 4500 and the outer side wall of the handle 4100. The reserved gaps are configured to prevent the push button 4500 from being stuck in a pressing direction perpendicular to the axial direction of the handle 4100. In the above manner, the push button 4500 in the present disclosure is disposed on the handle 4100 through the support member 4600, and the reserved gaps are formed between the push button 4500 and the support member 4600, and between the push button 4500 and the outer wall of the handle 4100. Therefore, the push button 4500 and the support member 4600 have better centering, thereby ensuring that the push button 4500 is not easily stuck.

Figure 32:
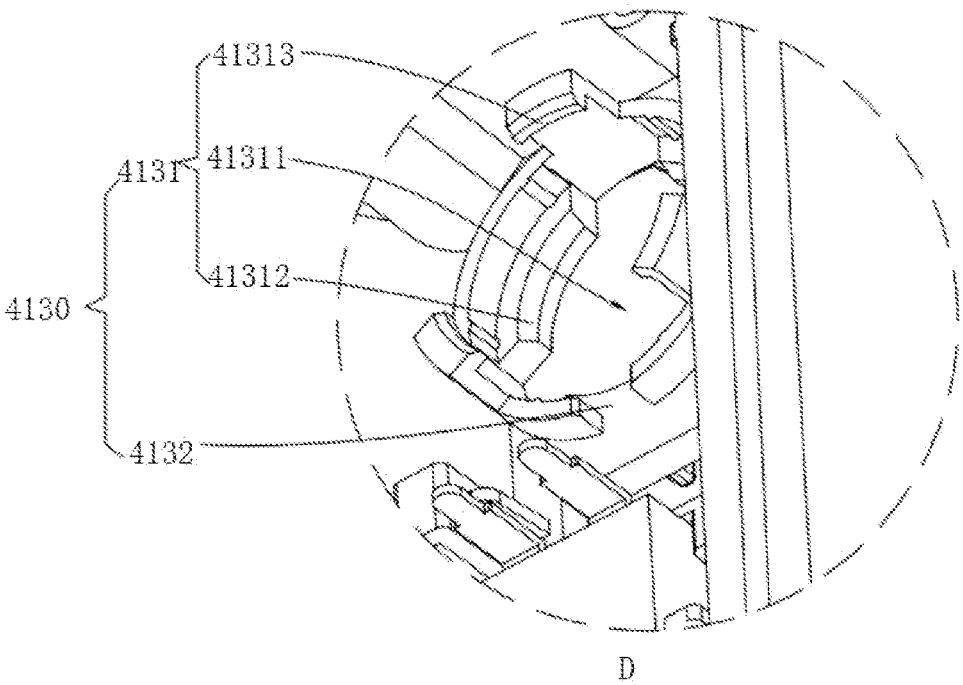
FIG. 32 is an enlarged schematic view of an area D in FIG. 31.
Figure 33:
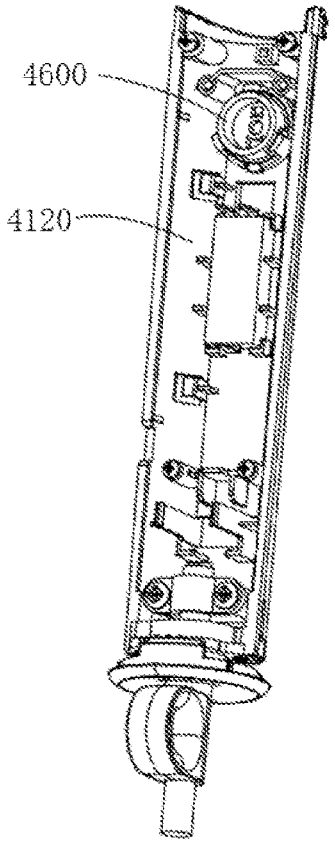
FIG. 33 is a schematic view of the handle inner frame and a support after installation in the present disclosure.
Figure 42:
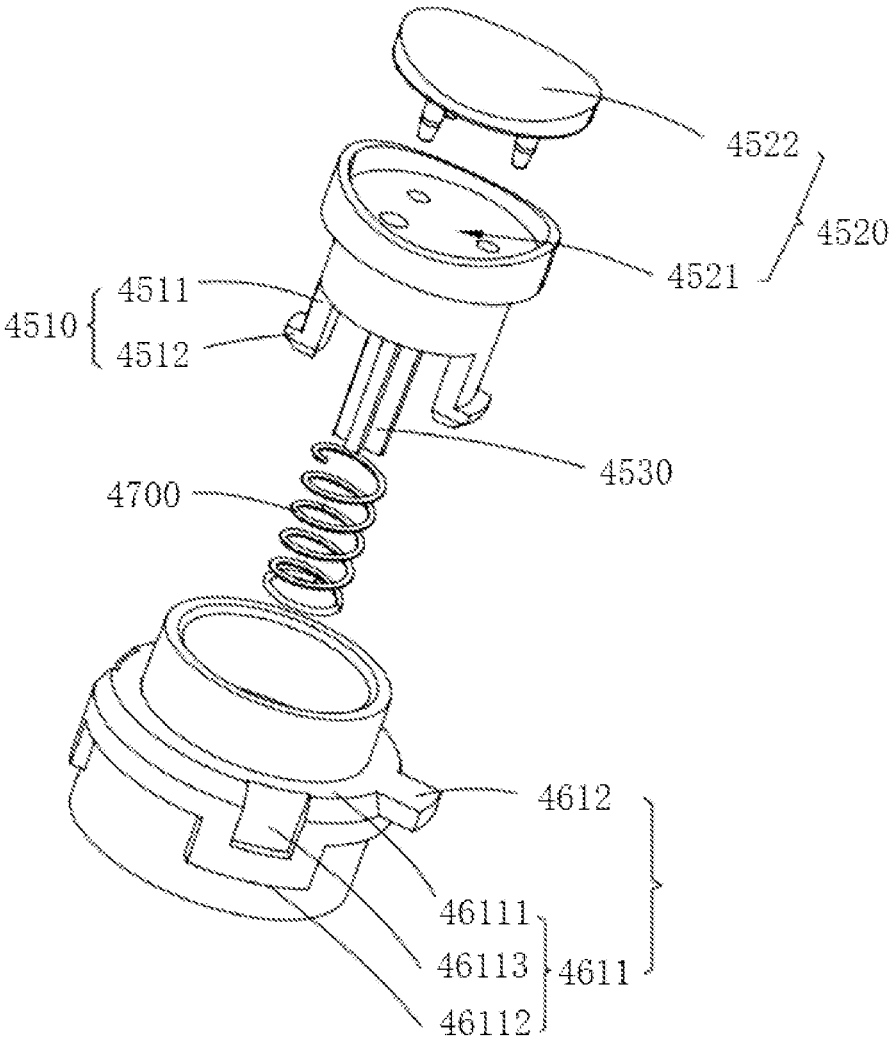
FIG. 42 is an exploded schematic view of the button assembly in a top view direction of the present disclosure.

Further, referring to FIG. 42, the first connection structure 4610 includes a first axial locking structure 4611 and a first circumferential positioning structure 4612. Referring to FIG. 32, the second connection structure 4130 is disposed on the handle inner frame 4120. The second connection structure 4130 includes a second axial locking structure 4131 matched with the first axial locking structure 4611, and a second circumferential positioning structure 4132 matched with the first circumferential positioning structure 4612. The cooperation between the first axial locking structure 4611 and the second axial locking structure 4131 can realize the axial positioning and connection of the support member 4600 and the handle 4100. The cooperation between the first circumferential positioning structure 4612 and the second circumferential positioning structure 4132 can realize the circumferential positioning of the support member 4600 and the handle 4100. As a result, the effective installation of the support member 4600 on the handle 4100 can be realized, which has the advantages of stable and reliable connection.

Specifically, the first axial locking structure 4611 includes a first locking shoulder 46111 and a second locking shoulder 46112 which are formed on the outer circumferential wall of the support member 4600. The first locking shoulder 46111 is disposed adjacent to the push button 4500. The second locking shoulder 46112 is disposed away from the push button 4500. The second axial locking structure 4131 includes a mounting hole 41311 formed in the handle inner frame 4120, a hole shoulder 41312 formed on a hole wall of the mounting hole 41311 and engaged with the first locking shoulder 46111, and a hook 41313 engaged with the locking shoulder 46112. The hole shoulder 41312 and the hook 41313 are located at opposite ends of the mounting hole 41311, respectively. Referring to FIG. 42, in order to facilitate the engagement of the hook 41313 with the locking shoulder 46112, the outer circumferential wall of the support member 4600 is provided with guide grooves 46113 distributed along the axial direction thereof. That is, the guide grooves 46113 are distributed along a direction from the first locking shoulder 46111 to the second locking shoulder 46112. A beginning end of the guide groove 46113 is formed with an introduction port on the first locking shoulder 46111, and a gap is formed between an end and the second locking shoulder 46112. By providing the guide groove 46113, the hook 41313 can pass over the first locking shoulder 46111 and then engage with the second locking shoulder 46112.

In this embodiment, for the convenience of positioning, the first circumferential positioning structure 4612 is set as a protrusion formed at the first locking shoulder 46111 and growing along the radial direction of the first locking shoulder 46111. The second circumferential positioning structure 4132 is set as a groove formed at an edge of the mounting hole 41311. During installation, the circumferential positioning can be completed only by aligning the above-mentioned protrusion with the above-mentioned groove, which has the advantages of simple structure, convenient alignment and convenient installation.

Figure 41:
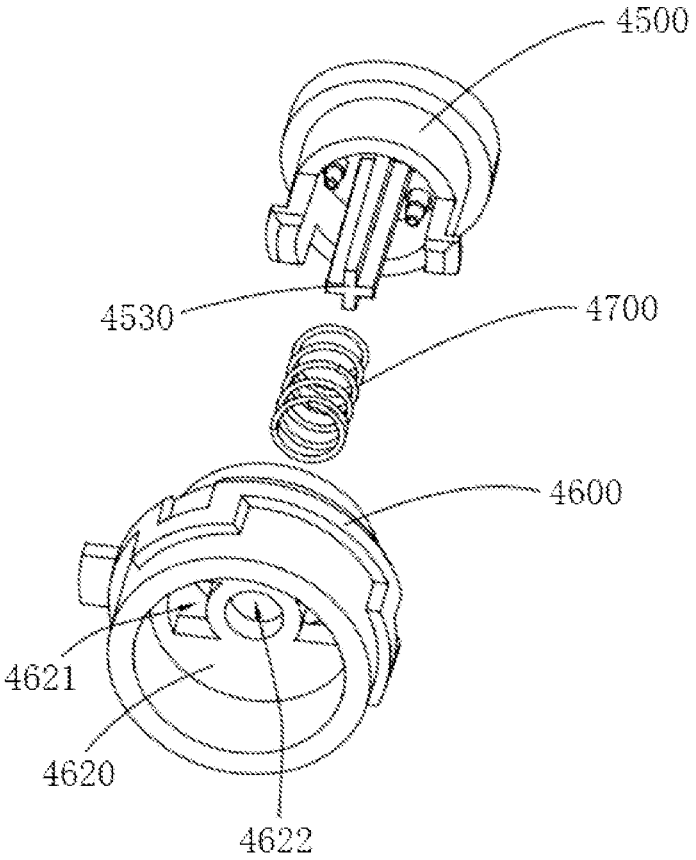
FIG. 41 is an exploded schematic view of a push button assembly in a bottom view direction of the present disclosure.

Further, referring to FIG. 41 and FIG. 42, the push button 4500 further includes a pressing block 4520 connected with the locking structure 4510 and exposed on the outer side wall of the handle 4100. A center of the inner end surface of the pressing block 4520 is provided with a rib rod 4530 for pressing and triggering the push switch 4800. The locking structure 4510 includes at least one connecting leg 4511 disposed on the pressing block 4520, and a push button buckle 4512 formed on an end of the connecting leg 4511. The connecting leg 4511 is disposed on the inner end surface of the pressing block 4520 and distributed along the pressing direction of the push button 4500. The pressing block 4520 and the push button buckle 4512 are respectively located on opposite sides of the connecting leg 4511. The support member 4600 is hollow in the interior and provided with openings at both ends so as to form a cavity extending through the support member 4600. A partition plate 4620 is formed in the cavity and extends perpendicular to its axial direction. The partition plate 4620 is provided with a locking slot 4621 for the connecting leg 4511 to pass through. After the connecting leg 4511 passes through the locking slot 4621, the push button buckle 4512 of the locking structure 4510 is engaged with the partition plate 4620, thereby realizing the connection between the push button 4500 and the support member 4600. The partition plate 4620 is also provided with a through hole 4622. The through hole 4622 enables the rib rod 4530 to pass through to the side of the push switch 4800 for cooperation therewith. An elastic element 4700 is also disposed between the push button 4500 and the support member 4600. The elastic element 4700 is sleeved on the rib rod 4530 and located in an area surrounded by the partition plate 4620 and the push button 4500. An end face of the elastic element 4700 abuts against the pressing block 4520, and an opposite end face abuts against the partition plate 4620, so as to provide a restoring force of the push button 4500.

A push button hole 4140 for accommodating the pressing block 4520 is provided on the side wall of the handle shell 4110. When the pressing block 4520 is in a reset state, the outer end surface of the pressing block 4520 is flush with the side wall of the handle shell 4110, or slightly convex on the side wall of the handle shell 4110, or slightly concave on the side wall of the handle shell 4110.

Figure 29:
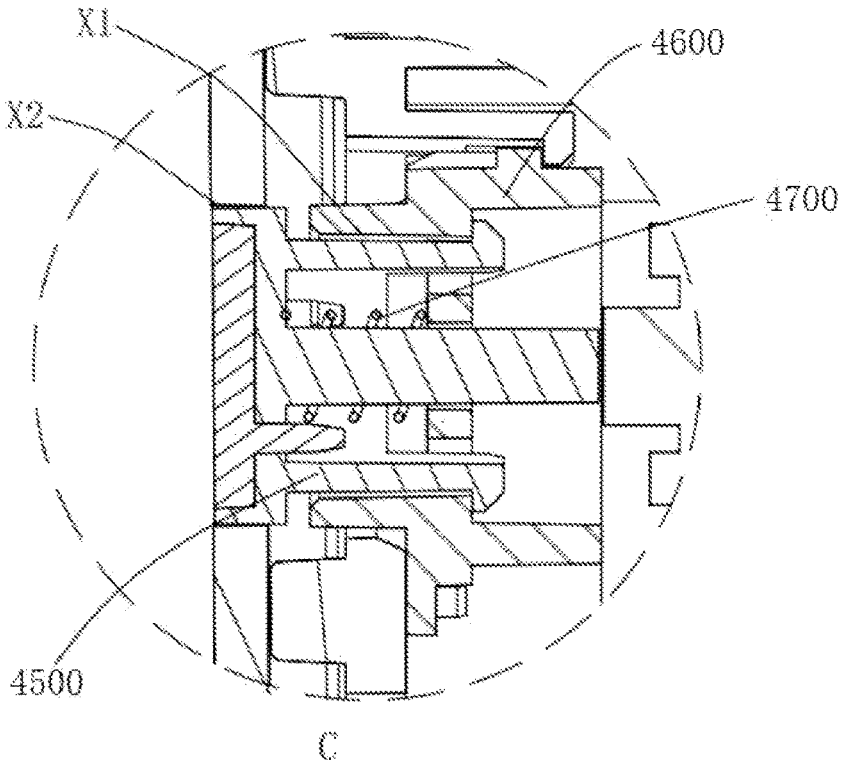
FIG. 29 is an enlarged schematic view of an area C in FIG. 28.

In this embodiment, referring to FIG. 28 and FIG. 29, the reserved gap between the push button 4500 and the outer side wall of the handle 4100 is an annular appearance gap X2 which is formed between the outer circumferential wall of the pressing block 4520 and the hole wall of the push button hole 4140. The reserved gap between the push button 4500 and the support member 4600 is an annular installation gap X1 which is formed between the connecting leg 4511 and the cavity wall of the support member 4600.

Further, the pressing block 4520 includes a base body formed with a cover groove 4521 and a light-shielding button cover 4522 fastened in the cover groove 4521. The base body of the pressing block 4520 is made of light-transmitting material, so as to form an annular light strip in the circumferential direction of the button cover 4522. In this embodiment, LED lights are also arranged on the electric control board. Each time the push button 4500 triggers the push switch 4800, the color of the LED lights changes accordingly. Different colors of LED lights represent different wind temperatures. The base body of the pressing block 4520, the locking structure 4510 and the support member 4600 are all made of transparent light-transmitting materials, so that the base body of the pressing block 4520, the locking structure 4510 and the support member 4600 can change with the colors of the LED lights. Therefore, it is realized that the air temperature is judged by the color of the annular light strip, which has the advantages of convenient use and beautiful appearance.

It can be understood that the push button assembly in the present disclosure can be applied to different usage scenarios, and the following examples are used for description.

The push button assembly of the present disclosure can be applied to a hair dryer. The hair dryer includes the push button assembly, the handle 4100 provided with the push button assembly, and a blower located above handle 4100 and connected to handle 4100. In a direction from the air inlet of the blower to the air outlet of the blower, an air inlet cover, a fan wheel, a motor, a heating wire assembly and an air outlet cover are sequentially arranged inside the blower. The push button assembly can be adjusted by the switch 4200 to realize the on-off control of the motor and the heating wire assembly, and the adjustment of the motor speed.

It can be understood that the above specific applications are only examples of the push button assembly in the present disclosure, and those skilled in the art can make adaptive adjustments according to the actual situation, which will not be repeated here.

In summary, the push button in the present disclosure is snapped to the sliding member through the cooperation between the first snap structure and the second snap structure, so as to realize the gear adjustment of the adjustment switch. By setting the width dimensions of the pair of snap portions differently, the efficiency and accuracy of installation are improved.

The first ribs distributed along the axial direction of the handle are arranged on the inner wall of the push button to reduce the contact area between the inner wall of the push button and the outer wall of the handle, thereby reducing the frictional resistance when the push button moves. In the present disclosure, the connecting line between any point on the protruding strip and any point on the trigger portion is set at the included angle M with the axial direction of the handle.

In this way, the push button can be pushed even when a small force is applied, which effectively improves the comfort of use. The push button in the present disclosure is arranged on the handle through the support member, and there are reserved gaps between the push button and the support member, and between the push button and the outer side wall of the handle. As a result, the push button and the support member have better centering, thereby ensuring that the push button is not easily stuck.

Although the embodiments of the present disclosure have been disclosed above, they are not limited to the applications listed in the description and the embodiments, and can be applied to various fields suitable for the present disclosure. Additional modifications can readily be implemented by those skilled in the art. Therefore, the present disclosure is not limited to the specific details and illustrations shown and described herein without departing from the general concept defined by the claims and the scope of equivalents.

What is claimed is:

1. A hair dryer, comprising:

an air cylinder; and a handle assembly disposed below the air cylinder, the handle assembly comprising a handle shell which is detachably disposed on the air cylinder;

wherein a communication port is provided on an outer side wall of the air cylinder, a mounting rib plate is distributed in a circumferential direction of the communication port, and the mounting rib plate is configured to connect the handle assembly;

wherein the mounting rib plate is provided with an air cylinder snap structure, a top of the handle shell is provided with a shell snap structure; and the shell snap structure is configured to mate with the air cylinder snap structure, so as to realize circumferential positioning and axial snapping between the air cylinder and the handle shell.

2. The hair dryer according to claim 1, wherein:

the air cylinder snap structure comprises an insertion slot M and a snap slot N formed on the mounting rib plate, and the shell snap structure comprises an insertion block Q and a buckle P disposed on the top of the handle shell; or the air cylinder snap structure comprises an insertion block Q1 and a buckle P1 formed on the mounting rib plate, and the shell snap structure comprises an insertion slot M1 and a snap slot N1 disposed on the top of the handle shell;

wherein the insertion block is matched with the insertion slot, and the buckle is matched with the snap slot.

3. The hair dryer according to claim 1, wherein:

the handle assembly further comprises a handle inner frame supporting an electronic control component, and the handle inner frame is detachably arranged in the handle shell;

wherein a top of the handle inner frame is provided with an inner frame central fastening structure, the mounting rib plate is also provided with an air cylinder central fastening structure matched with the inner frame central fastening structure, the handle inner frame is connected to the air cylinder through a matching relationship between the inner frame central fastening structure and the air cylinder central fastening structure.

4. The hair dryer according to claim 3, wherein:

the air cylinder central fastening structure comprises a central positioning hole formed on the mounting rib plate, the inner frame central fastening structure comprises a central positioning post and first hole posts arranged on the handle inner frame, the central positioning post and the first hole posts are distributed along an axial direction perpendicular to the handle shell;

wherein the central positioning hole and the central positioning post are respectively located on symmetrical planes of the air cylinder and the handle assembly, the central positioning post is matched with the central positioning hole, the first hole posts are symmetrically arranged on both sides of the central positioning post, the first hole posts are configured to screw the air cylinder and the handle inner frame.

5. The hair dryer according to claim 3, wherein:

the handle inner frame is a frame body of a semi-cylindrical configuration, an inner space of the handle shell is divided into a first semi-cylindrical area and a second semi-cylindrical area; wherein the handle inner frame is located in the second semi-cylindrical area, and the shell snap structure is located in the first semi-cylindrical area.

6. The hair dryer according to claim 4, wherein:

the central positioning post is in a form of a square cylinder, and the central positioning hole is in a shape of a square hole.

7. The hair dryer according to claim 3, wherein:

detachable connection is achieved between the handle shell and the handle inner frame through a circumferential positioning structure and an end surface positioning and fastening structure.

8. The hair dryer according to claim 7, wherein:

the circumferential positioning structure comprises a first positioning groove which is arranged on an inner wall of the top of the handle shell and a first positioning block which is arranged on an outer wall of the top of the handle inner frame;

wherein the first positioning groove and the first positioning block constitute a top circumferential positioning substructure.

9. The hair dryer according to claim 8, wherein:

the circumferential positioning structure further comprises a second positioning block which is arranged on the inner wall of a bottom of the handle shell and a second positioning groove which is arranged on the outer wall of a bottom of the handle inner frame;

wherein the second positioning block and the second positioning groove constitute a bottom circumferential positioning substructure; the bottom circumferential positioning substructure and the top circumferential positioning substructure together constitute the circumferential positioning structure.

10. The hair dryer according to claim 7, wherein:

the end surface positioning and fastening structure comprises a second protrusion located at a bottom of an inner side of the handle shell, and a second hole post and an end surface positioning hole which are formed on a bottom end surface of the handle inner frame; wherein the second protrusion is fixed on an inner side wall of the handle shell and distributed along a radial direction of the handle shell; the second protrusion is provided with a through hole for a screw to pass through to the second hole post, and an end surface positioning post distributed along an axial direction of the handle shell and used for matching with the end surface positioning hole.

11. A push button assembly, applied to a hair dryer which has a handle with an adjustment switch located inside the handle, comprising:

a push button arranged on an outside of the handle, the push button having a first snap structure extending into an inside of the handle; and a sliding member arranged inside the handle and having a second snap structure, the sliding member being configured to connect the push button and the adjustment switch;

wherein the push button is snapped to the sliding member through a cooperation between the first snap structure and the second snap structure, so as to push a trigger portion on the adjustment switch to slide linearly in an axial direction of the handle.

12. The push button assembly according to claim 11, wherein:

the first snap structure comprises a snap portion, and the second snap structure comprises a snap slot portion; and wherein after the snap portion is snapped into the snap slot portion, the push button has a translational freedom to move along the axial direction of the handle.

13. The push button assembly according to claim 12, wherein:

a pair of the snap portions are arranged on the push button, and width dimensions of the pair of snap portions in the axial direction of the handle are different.

14. The push button assembly according to claim 12, wherein:

the snap portion comprises a second extension block and a buckle, one end of the second extension block is fixed on the push button and grows along the axial direction perpendicular to the handle, the buckle is formed on another end of the second extension block;

the snap slot portion comprises a second through hole for the second extension block to pass through, and a pair of stoppers formed on both sides of the second through hole and used for locking with the snap portion;

wherein after the second extension block is inserted into the second through hole and the buckle is engaged with the stoppers, an inner side wall of the push button abuts against an outer side wall of the handle.

15. The push button assembly according to claim 14, wherein:

the inner side wall of the push button is provided with first ribs distributed along the axial direction of the handle to reduce a contact area between an inner wall of the push button and an outer wall of the handle; and wherein the first ribs are located on opposite sides of the snap portion.

16. The push button assembly according to claim 14, wherein:

the stoppers comprise a first stopper engaged with the buckle and a second stopper inclined toward the first stopper; wherein the first stopper and the second stopper are arranged opposite to each other; after the buckle is engaged with the first stopper, the second stopper abuts against the second extension block, so that the second extension block abuts against the first stopper.

17. The push button assembly according to claim 11, wherein:

the handle comprises a handle shell with a hollow interior along the axial direction of the handle to form an accommodating cavity, and a handle inner frame detachably disposed in the accommodating cavity and supporting the adjustment switch; wherein the handle inner frame is provided with an opening matched with the sliding member.

18. The push button assembly according to claim 17, wherein:

side wings are symmetrically arranged on two opposite side edges of the sliding member, the side wings are configured to restrict movement of the sliding member in a width direction and a thickness direction of the opening; and wherein a length direction of the opening is parallel to the axial direction of the handle.

19. The push button assembly according to claim 11, wherein:

an outer side wall of the push button is formed with a protruding strip which is convenient for pushing the push button, the protruding strip is distributed along a circumferential direction of the handle; wherein a connecting line of any point on the protruding strip and any point on the trigger portion forms an included angle M with respect to the axial direction of the handle, and a value range of the included angle M is: 20° to 70°.

20. A hair dryer, comprising a push button assembly and a handle with an adjustment switch located inside the handle, the push button assembly comprising:

a push button arranged on an outside of the handle, the push button having a first snap structure extending into an inside of the handle; and a sliding member arranged inside the handle and having a second snap structure, the sliding member being configured to connect the push button and the adjustment switch;

wherein the push button is snapped to the sliding member through a cooperation between the first snap structure and the second snap structure, so as to push a trigger portion on the adjustment switch to slide linearly in an axial direction of the handle.

* * * * *